US008177320B2

(12) United States Patent
Hagiwara

(10) Patent No.: US 8,177,320 B2
(45) Date of Patent: May 15, 2012

(54) CARRIAGE AND IMAGE FORMING DEVICE INCLUDING CARRIAGE

(75) Inventor: Takumi Hagiwara, Aichi (JP)

(73) Assignee: Ricoh Company, Ltd., Tokyo (JP)

( * ) Notice: Subject to any disclaimer, the term of this patent is extended or adjusted under 35 U.S.C. 154(b) by 415 days.

(21) Appl. No.: 12/494,432

(22) Filed: Jun. 30, 2009

(65) Prior Publication Data

US 2010/0007689 A1 Jan. 14, 2010

(30) Foreign Application Priority Data

Jul. 8, 2008 (JP) ..... 2008-178356
May 22, 2009 (JP) ..... 2009-124540

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS 7,731,330 B2 * 6/2010 Nakata et al. ..... 347/37
7,789,475 B2 * 9/2010 Morishita et al. ..... 347/19
2008/0225066 A1 9/2008 Yorimoto et al.
2008/0225067 A1 9/2008 Morino et al.
2008/0225068 A1 9/2008 Morino et al.
2008/0225098 A1 9/2008 Hagiwara et al.
2008/0231649 A1 9/2008 Kawabata et al.
2009/0015621 A1 1/2009 Hirota et al.

FOREIGN PATENT DOCUMENTS

JP 2005-349799 12/2005
JP 2006-272770 10/2006

* cited by examiner

*Primary Examiner* — Stephen Meier
*Assistant Examiner* — Tracey McMillion
(74) *Attorney, Agent, or Firm* — IPUSA, PLLC

(57) ABSTRACT

In a carriage of a liquid drop discharging device, an encoder sensor is arranged to read slits on a linear scale at a slit reading position. The carriage includes a stain detection part that detects a stain on the linear scale based on position information output from the encoder sensor. An encoder sensor moving part moves the encoder sensor from the slit reading position in a width direction of the linear scale. An encoder sensor movement control part controls movement of the encoder sensor from the slit read position by the encoder sensor moving part based on stain information output from the stain detection part.

7 Claims, 19 Drawing Sheets

CARRIAGE AND IMAGE FORMING DEVICE INCLUDING CARRIAGE

BACKGROUND OF THE INVENTION

1. Field of the Invention

This invention relates to a carriage and an image forming device including a carriage arranged therein.

2. Description of the Related Art

In an ink jet type image forming device, a linear scale is arranged in a position corresponding to a movable range of a carriage which carries an ink discharging device. On the linear scale, a number of slits are formed at given intervals in the longitudinal direction of the linear scale. An encoder sensor is arranged on the carriage to read the slits on the linear scale. By using the encoder sensor to read the slits on the linear scale, the position information of the carriage in the main scanning direction is acquired.

In the image forming device, the transfer timing of image data and the discharge timing of the ink from the ink discharge head are determined based on the position information of the carriage, thereby carrying out the image formation with high quality.

However, if ink mist, paper dust, etc. adhere to the linear scale, it is difficult for the encoder sensor on the carriage to read correctly the slits on the linear scale, and an error may arise in the detected position information of the carriage.

As a result, the timing of discharging of the ink is shifted inappropriately, which will cause the deviation of a printed image to present. When the stain on the linear scale is severe, it is impossible to detect the position information of the carriage, which may cause the carriage to collide with the side plate of the image forming device, and the image forming device may be physically damaged.

For this reason, it is desired to acquire accurate position information of the carriage detected by the encoder sensor.

For example, Japanese Laid-Open Patent Publication No. 2005-349799 discloses an image forming device in which the mist of an ink discharged from the discharge head is charged, and the ink mist around the carriage is attracted and removed, so that the inside of the image forming device is kept clean and no stain is present.

In the image forming device disclosed in Japanese Laid-Open Patent Publication No. 2005-349799, a discharge head is arranged to include a charging electrode for charging the mist of the ink, and a dust-collecting electrode for attracting the mist of the charged ink. In this image forming device, the mist of the charged ink is collected by the dust-collecting electrode, and it is possible to prevent the mist of the ink from adhering to all the component parts of the image forming device including the linear scale.

Japanese Laid-Open Patent Publication No. 2006-272770 discloses an image forming device which is aimed at preventing the deviation of a printed image even when a stain is present partially on the linear scale. In this image forming device, when the carriage is moved at a fixed speed uniformly, the period of the output signals of the encoder sensor is checked. When an erroneous period of the output signals of the encoder sensor is detected, the linear scale is moved in the up/down direction of the linear scale (or the width direction of the linear scale). At this time, a clean portion of the linear scale in which no stain is present is found out, and the linear scale is moved to cause the encoder sensor to face the clean portion of the linear scale, so that the encoder sensor reads the slits on the linear scale. Thus, it is possible to acquire accurate position information of the carriage from the output signals of the encoder sensor.

The method of Japanese Laid-Open Patent Publication No. 2005-349799 uses the dust-collecting electrode for collecting the dust with the ink mist wherein the mist of the ink from the discharge head is charged. The method must be arranged to meet various conditions of the dispersing ink mist (the physical properties of the respective color inks, the mass of the ink mist, and the kinetic energy of the ink mist), and it is difficult to completely collect the dust with the ink mist. In some cases, the arrangement of the dust-collecting electrode may not be appropriate for prevention of the adhesion of the ink mist to the linear scale. For this reason, there is the problem that the remaining ink mist which cannot be collected by the dust-collecting electrode may adhere to the linear scale.

The method of Japanese Laid-Open Patent Publication No. 2006-272770 uses the movement of the linear scale which is large in the longitudinal direction to cause the encoder sensor to face the clean portion of the linear scale in which no stain is present. To perform the movement of the long linear scale in the up/down direction, the rigidity of the linear scale, the accuracy of the control of the driving source, etc. must be taken into consideration. If a mechanical deviation in the linear scale is present, the reliability of the reading of the slits on the linear scale by the encoder sensor will be insufficient.

In the image forming device of Japanese Laid-Open Patent Publication No. 2006-272770, the stain on the linear scale can be accurately detected by the encoder sensor only when the carriage is moved at the fixed speed. If the carriage is moved in an accelerating or decelerating state, the stain on the linear scale is not accurately detected by the encoder sensor. Due to inaccurate reading of the slits on the linear scale by the encoder sensor, a deviation of a printed image or overrunning of the carriage may arise.

SUMMARY OF THE INVENTION

In one aspect of the invention, the present disclosure provides a carriage which operates normally over an extended period of time based on the position information from the encoder sensor which is controlled to read the slits on the linear scale accurately.

In one aspect of the invention, the present disclosure provides an image forming device, including the carriage arranged therein, which is able to form an image with high quality over an extended period of time.

In an embodiment of the invention which solves or reduces one or more of the above-mentioned problems, the present disclosure provides a carriage of a liquid drop discharging device in which an encoder sensor is arranged to read slits on a linear scale at a slit reading position, the carriage comprising: a stain detection part to detect a stain on the linear scale based on position information output from the encoder sensor; an encoder sensor moving part to move the encoder sensor from the slit reading position in a width direction of the linear scale; and an encoder sensor movement control part to control movement of the encoder sensor from the slit reading position by the encoder sensor moving part based on stain information output from the stain detection part.

In an embodiment of the invention which solves or reduces one or more of the above-mentioned problems, the present disclosure provides an image forming device in which a carriage of a liquid drop discharging device is arranged, including an encoder sensor arranged to read slits on a linear scale at a slit reading position, the carriage comprising: a stain detection part to detect a stain on the linear scale based on position information output from the encoder sensor; an encoder sensor moving part to move the encoder sensor from the slit reading position in a width direction of the linear scale;

and an encoder sensor movement control part to control movement of the encoder sensor from the slit reading position by the encoder sensor moving part based on stain information output from the stain detection part.

Other objects, features and advantages of the present invention will become more apparent from the following detailed description when read in conjunction with the accompanying drawings.

DETAILED DESCRIPTION OF THE PREFERRED EMBODIMENTS

A description will be given of embodiments of the invention with reference to the accompanying drawings.

Figure 1:
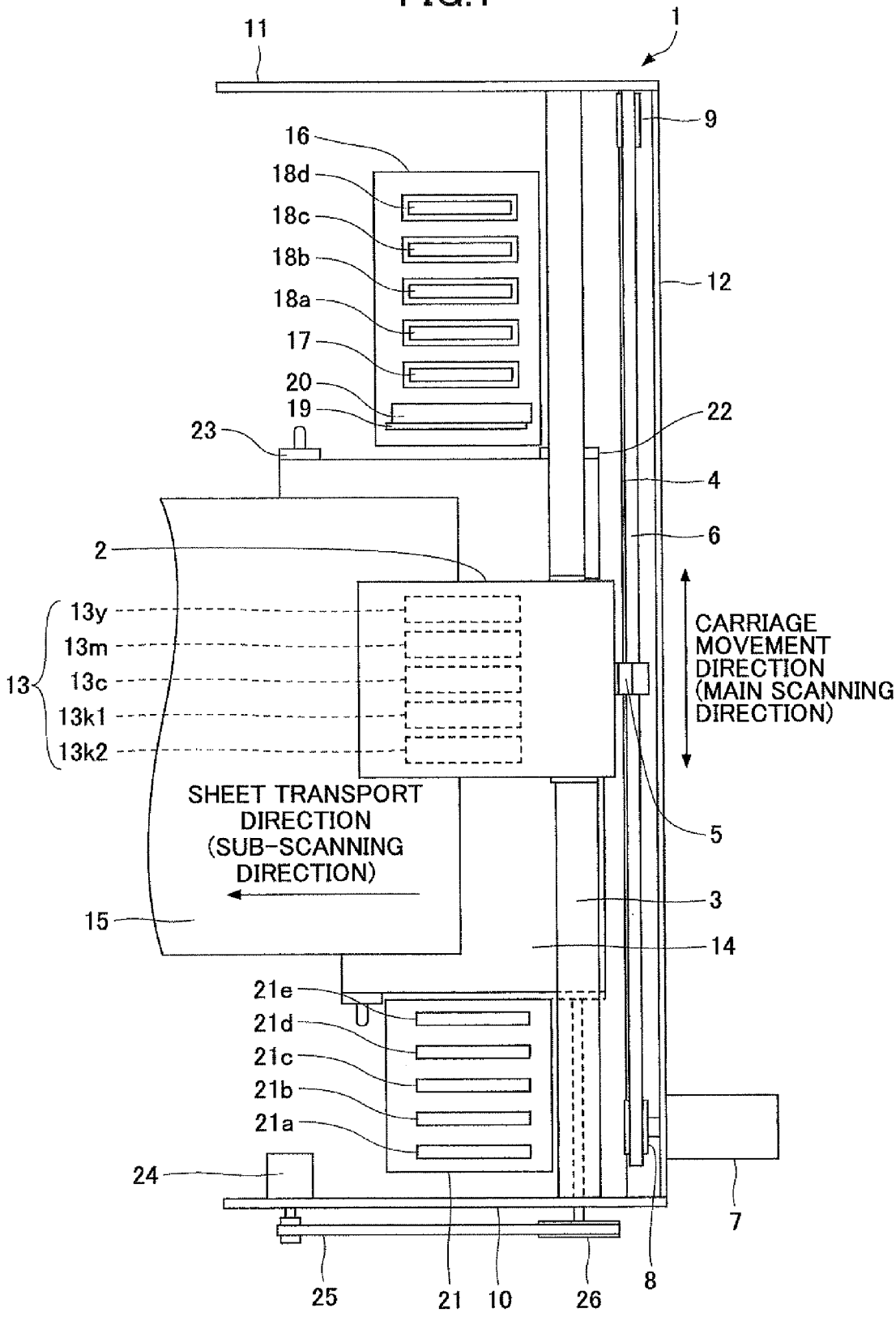
FIG. 1 is a top view of a principal part of an image forming device of an embodiment of the invention.

FIG. 1 is a top view of a principal part (print engine) of an image forming device of an embodiment of the invention.

As illustrated in FIG. 1, in the image forming device 1 of this embodiment, a carriage 2 is held to be movable in a main scanning direction by a carriage guide 3 which is transversely arranged between a front side plate 10 and a back side plate 11, and by a guide stay (not illustrated) which is arranged in a back stay 12.

The carriage 2 is moved to perform a scanning of a printing medium 15 in the main scanning direction by a main scanning motor 7 through a timing belt 6 which is arranged between a drive pulley 8 and an idler pulley 9.

The carriage 2 carries five recording heads 13 on the carriage 2. Among these recording heads, the recording heads 13*k*1 and 13*k*2 constitute two liquid drop discharge heads which discharge drops of black (Bk) ink, and each of the recording heads 13*c*, 13*m*, and 13*y* constitutes a liquid drop discharge head which discharges drops of a corresponding one of cyan (C) ink, magenta (M) ink, and yellow (Y) ink. In the following, when the five recording heads are referred to collectively, they will be called the recording head 13 (liquid drop discharging unit).

The image forming device 1 is a shuttle type image forming device which forms an image on a printing medium. Specifically, if the image forming device 1 starts image formation, a printing medium 15 (a liquid drop receiving medium) on a transport belt 14 is transported in a sheet transport direction (sub-scanning direction), and the carriage 2 is moved in the main scanning direction and the recording head 13 on the carriage 2 discharges liquid drops to the printing medium 15.

Examples of the recording head 13 include the following. A piezoelectric type head uses a piezoelectric element as a pressure generating part (actuator part) which pressurizes the ink in an ink passage (pressure generating chamber). The piezoelectric element deforms a diaphragm which forms the surface of the wall of the ink passage to change the internal volume of the ink passage and discharge an ink drop from the nozzle. A thermal type head uses a heating resistor to heat the ink in the ink passage and generate air bubbles in the ink, so that an ink drop is discharged by the resulting pressure. An electrostatic type head includes a diaphragm (which forms the surface of the wall of the ink passage) and electrodes, in which the diaphragm and the electrodes are arranged to confront each other, and the internal volume of the ink passage is changed by an electrostatic force generated between the diaphragm and the electrodes, so that an ink drop is discharged from the nozzle.

The image forming device 1 includes a linear scale 4 which includes the slits formed thereon and is arranged between the front side plate 10 and the back side plate 11 along the main scanning direction of the carriage 2, and an encoder sensor 5 which is arranged on the back side (the side of the back stay 1) of the carriage 2 to detect the slits on the linear scale 4 by the movement of the carriage 2.

Based on the signal output from the encoder sensor 5 according to the movement of the carriage 2, the image forming device performs drive control of the main scanning motor 7 to carry out main scanning control of the carriage 2 at a required speed by a required amount of movement.

As illustrated in FIG. 1, in the non-printing area of one side of the carriage 2 in the main scanning direction, a maintenance/recovery device 16 is arranged to maintain and recover the states of the nozzles of the recording head 13.

This maintenance/recovery device 16 is a capping member which performs capping of the nozzle faces of the five recording heads 13, and provided with the following elements: a suction and moisture-keeping cap 17; four moisture-keeping caps 18*a*-18*d*; a wiper blade 19 (which is a wiping component for wiping the nozzle faces of the recording heads 13); and a first dummy discharge receptacle 20 for performing dummy discharge.

In the non-printing area of the other side of the carriage 2 in the main scanning direction, a second dummy discharge receptacle 21 for performing dummy discharge is arranged. The openings 21*a*-21*e* are formed in the second dummy discharge receptacle 21.

A sub-scanning transport part (transport device) transports the printing medium 15, which is fed from the lower part of the image forming device, by changing the transport direction by about 90 degrees, so that the printing medium 15 faces the recording heads of the image formation part. The sub-scanning transport part includes an endless transport belt 14 which is wound between a driven roller 23 (tension roller) and a transport roller 22 (driving roller).

In the sub-scanning transport part, the transport roller 22 is rotated by a sub-scanning motor 24 via a timing belt 25 and a timing roller 26 so that the transport belt 14 is rotated by the transport roller 22 to transport the recording-medium 15 in the sheet transport direction (the sub-scanning direction).

According to the movement of the carriage 2, an encoder sensor 5 reads the slits on the linear scale 4 at a predetermined position in the width direction of the linear scale 4, and detects the encoder position information. When it is determined that reading of the slits is difficult because of a stain on the linear scale 4, the encoder sensor 5 is moved to a clean slit reading position in the width direction of the linear scale 4 by the encoder sensor moving part 65 (refer to FIG. 2).

Then, the encoder sensor 5 is controlled to read the encoder position information in the clean slit reading position after the movement in the width direction of the linear scale 4. A stain detection part 70 (refer to FIG. 2) detects a stain on the linear scale 4 based on the information from the encoder sensor 5, and the encoder sensor movement control part 64 (refer to FIG. 2) controls the movement of the encoder sensor 5 by using the encoder sensor moving part 65 based on the stain information from the stain detection part 70.

Figure 2:
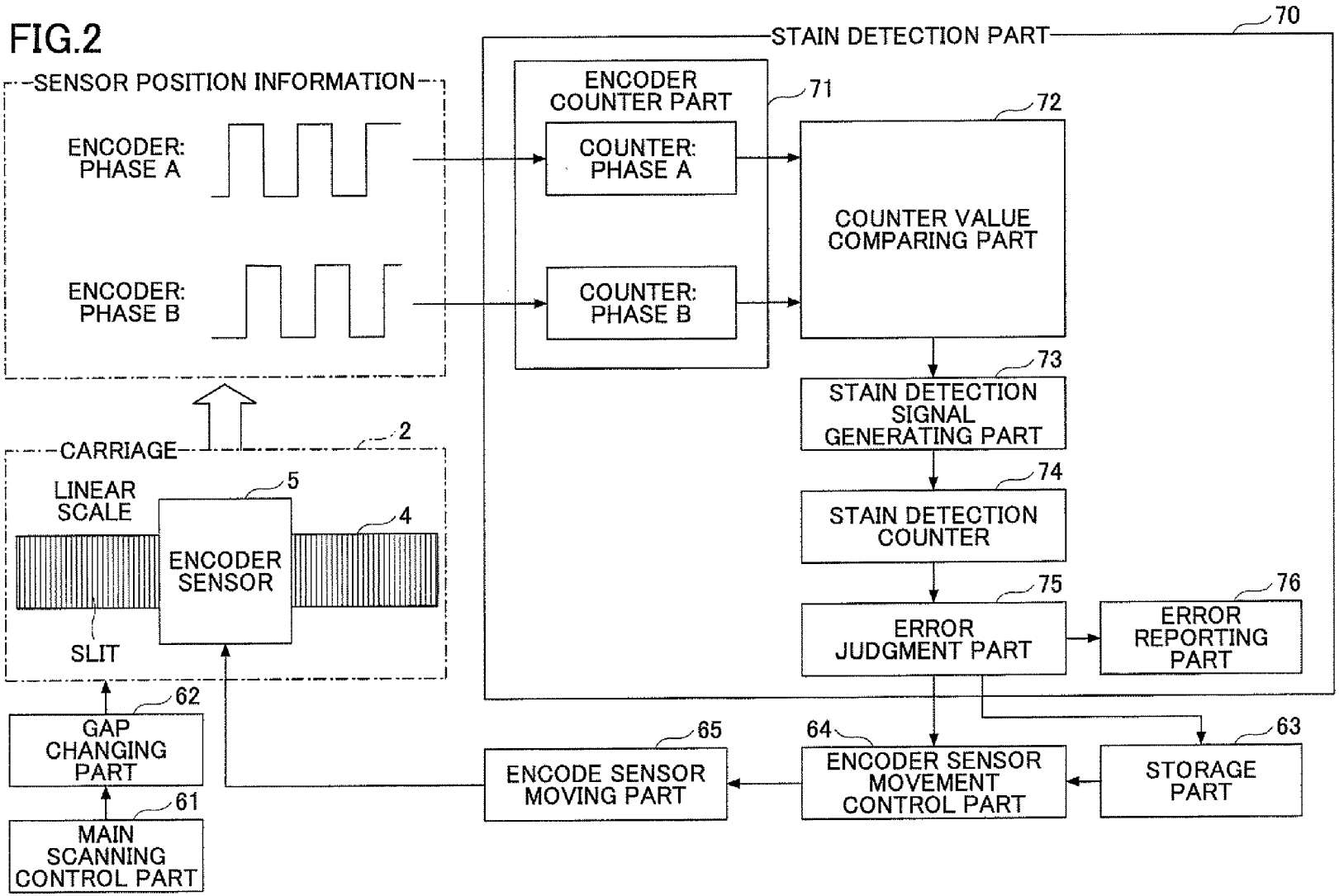
FIG. 2 is a block diagram illustrating the composition of a carriage of an embodiment of the invention including an encoder sensor movement control part.

FIG. 2 is a block diagram illustrating the composition of a carriage of an embodiment of the invention including an encoder sensor movement control part.

The encoder sensor 5 reads the slit position information on two adjacent positions on the linear scale 4. Two items of the read slit position information will be called encoder position information phase A and phase B. Usually, a number of slits are formed in the linear scale 4 at equal intervals in the longitudinal direction thereof, and the encoder position information phase A and phase B indicate pulsed signals of the same waveform with different phases, respectively.

As illustrated in FIG. 2, the stain detection part 70 which detects a stain on the linear scale 4, includes an encoder counter part 71 which reads the two encoder position information phase A and phase B from the encoder sensor 5, respectively.

The phase-A counter and the phase-B counter in the encoder counter part 71 respectively count the number of pulses in the encoder position information phase A and phase B and output the counter values of phase A and phase B. A counter value comparing part 72 compares the counter value of phase A and the counter value of phase B. When the counter value of phase A and the counter value of phase B are not equal as a result of the comparison by the counter value comparing part 72, a stain detection signal generating part 73 outputs a stain detection signal indicating a stain existing on the linear scale 4.

A stain detection counter 74 counts the stain detection signal output from the stain detection signal generating part 73. An error judgment part 75 determines whether an error takes place in the encoder sensor 5 (or a state in which the encoder position information cannot be properly detected), based on the count value from the stain detection counter 74.

When the error judgment part 75 determines from the count value of the stain detection counter 74 that an error takes place in the encoder sensor 5, an error reporting part 76 notifies a user of the occurrence of the error.

When the signal of the error judgment is received from the error judgment part 75, the encoder sensor movement control part 64 controls the driving of the encoder sensor moving part 65 to move the encoder sensor 5 on the carriage 2 in the width direction of the linear scale 4. Then, the encoder sensor 5 is controlled to read the slits on the linear scale 4 in the clean slit reading position after the movement.

The information of the clean slit reading position on the linear scale 4 may be stored beforehand in a storage part 63 so that the information stored in the storage part 63 is transmitted to the encoder sensor movement control part 64. Alternatively, the position where a stain on the linear scale 4 is detected by the stain detection part 74 may be stored in the storage part 63, and information of a position on the linear scale 4, other than the stain detected position stored in the storage part 63, is selected and transmitted to the encoder sensor movement control part 64.

A carriage main scanning control part 61 controls the main scanning of the carriage 2 by driving the main scanning motor 7 based on the encoder position information (phase A or phase B) from the encoder sensor 5. The printing control of the recording head is carried out by the printing control part (which is not illustrated) based on the encoder position information (phase A or phase B). A gap changing part 62, which adjusts the gap between the carriage 2 and a printing medium, is driven based on the information from the carriage main scanning control unit 61.

Figure 3:
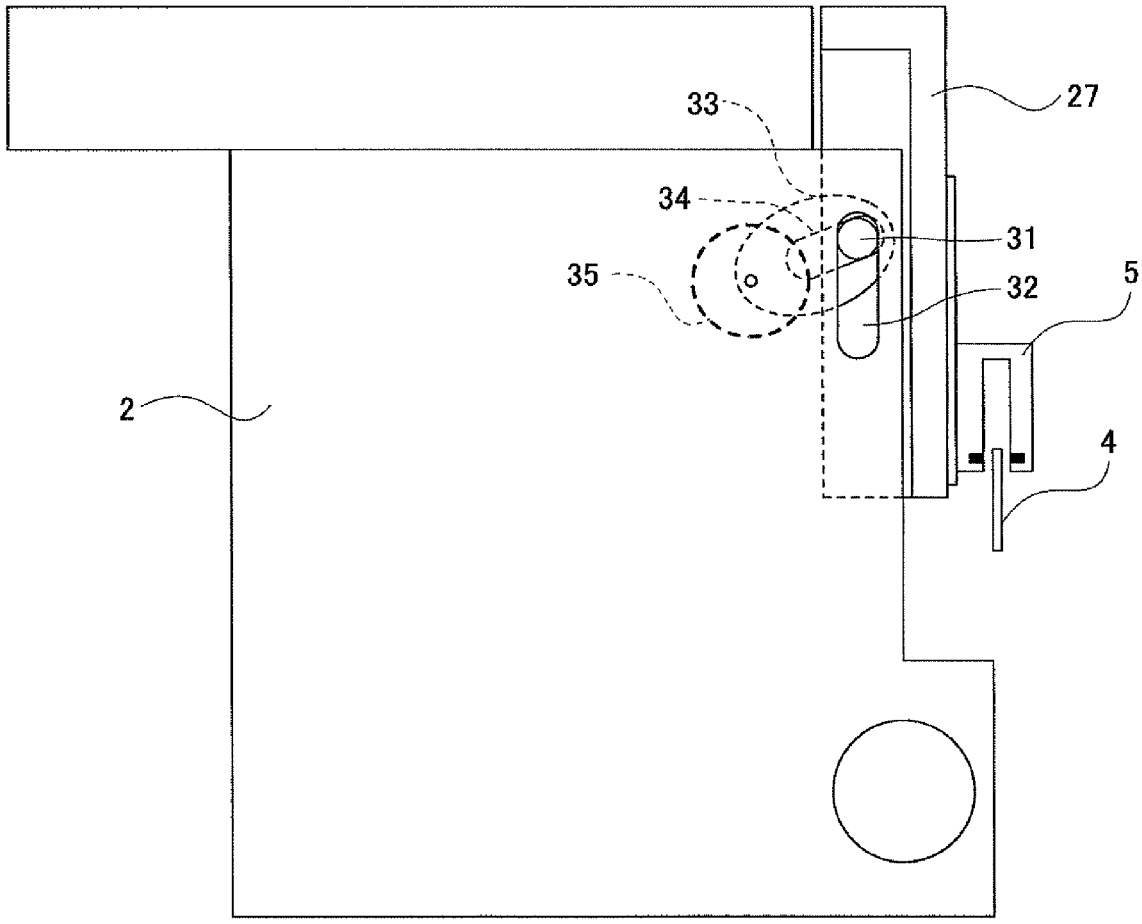
FIG. 3 is a side view of an example of an encoder sensor moving part.

FIG. 3 is a side view of an example of an encoder sensor moving part 65. For simplicity, this encoder sensor moving part 65 may also be called sensor moving part 65.

As illustrated in FIG. 3, a sensor guide shaft 31 to which the encoder sensor 5 is fixed is inserted into slots 32 (because the front slot 32*a* overlaps over the back slot 32*a*, the back slot 32*b* is not visible in FIG. 3) which are formed on both the side surfaces of the carriage 2, and this sensor guide shaft 31 is arranged along an encoder sensor holding part 27.

A cam plate 33 is arranged inside the carriage 2, and the cam plate 33 includes a slot 34. The sensor guide shaft 31 is inserted into the slot 34 of the cam plate 33. A sensor shift motor 35 includes a rotary shaft, and an off-center part of the cam plate 33 is fitted into the rotary shaft of the sensor shift motor 35. When the sensor shift motor 35 is driven to rotate the cam plate 33 around the rotary shaft, the encoder sensor 5 is vertically moved through the cam plate 33 by the movement of the sensor guide shaft 31 within the slot 32.

The driving of the sensor shift motor 35 is controlled in accordance with a control signal output from the encoder sensor movement control part 64.

A typical example of the sensor shift motor 35 is a stepping motor the amount of rotation of which can be controlled accurately. It is preferred that the amount of rotation of the motor 35 is measured by using a combination of a sensor shift scale and a sensor shift sensor (which are not illustrated), and the driving of the sensor shift motor 35 is controlled based on the result of the measurement. Moreover, it is preferred that the sensor shift sensor and the sensor shift scale are arranged inside the carriage 2, in order to prevent the sensor shift sensor and the sensor shift scale from being influenced by ink mist.

Figure 4:
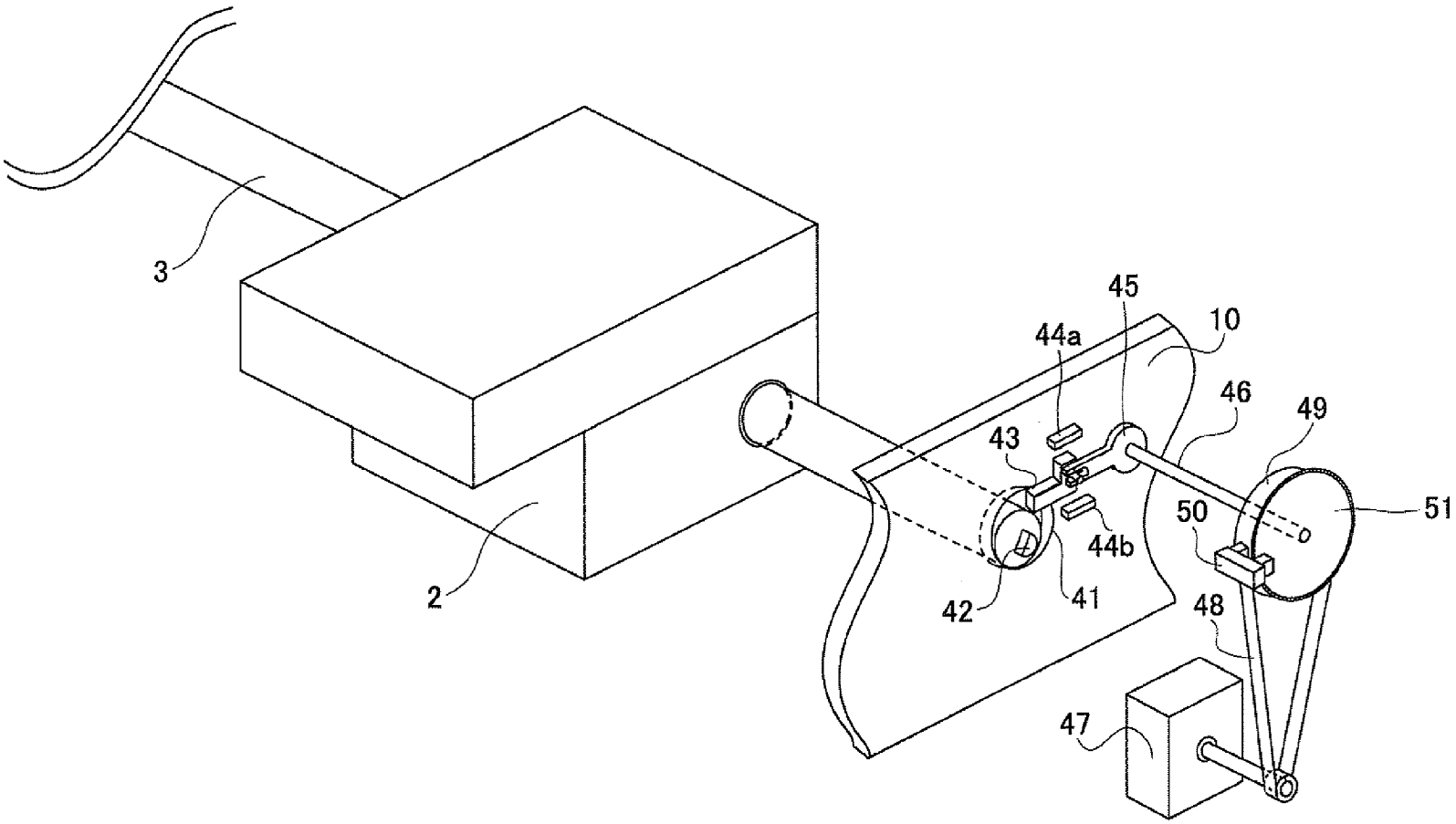
FIG. 4 is a perspective view of an example of a gap changing part.

FIG. 4 illustrates an example of a gap changing part 62. This gap changing part 62 is a device which adjusts a gap between the carriage 2 and the transport belt 14, i.e., a relative position of the carriage 2 to the main part of the image forming device 1 including the front side plate 10 and the back side plate 11, in the up/down direction.

If the carriage 2 is moved to the front side plate 10 and the back side plate 11 in the up/down direction, the encoder sensor 5 which is fixed to the carriage 2 is also moved to the front side plate 10 and the back side plate 11 in the up/down direction.

On the other hand, the linear scale 4 is fixed to the front side plate 10 and the back side plate 11, and the encoder sensor 5 is movable to the linear scale 4 in the width direction of the linear scale 4 (or the up/down direction) by using the gap changing part 62.

The main purpose of the gap changing part 62 is to set the gap between the carriage 2 and the transport belt 14 to a predetermined interval. For this purpose, the carriage 2 is provided with the encoder sensor moving part 65 as illustrated in FIG. 3, which is capable of vertically moving the encoder sensor 5 independently. This makes it possible to compensate for a change of the reading position of the encoder sensor 5 by the movement of the carriage 2 in the up/down direction.

The composition of the gap changing part 62 will be described. As illustrated in FIG. 4, the carriage 2 can be moved along the carriage guide 3. The end of the carriage guide 3 is coupled to a disk-like rotor plate 41 at an off-center part of the disk-like rotor plate 41.

The carriage guide 3 is fixed to the rotor plate 41 by a wedge 42 having a D-shaped cross-section so that the carriage guide 3 may not rotate freely to the rotor plate 41. The rotor plate 41 is fitted in a circular hole of the front side plate 10 of the image forming device such that the rotor plate 41 is freely rotatable. A lever 43 is attached to the rotor plate 41 such that the lever 43 is arranged along the front side plate 10. The rotational range of the lever 43 is regulated by a pair of upper and lower limiter parts 44*a* and 44*b* which are arranged on the front side plate 10. A projection is provided near the leading edge of the lever 43, and the projection of the lever 43 is engaged with a recess of a hook 45. The hook 45 is fixed to a hook guide shaft 46, and the hook 45 is rotatable according to the rotation of the hook guide shaft 46. The hook guide shaft 45 is rotatably connected to a gap adjusting motor 47 through a shift gear 51 and a timing belt 48.

The rotation of the gap adjusting motor 47 is transmitted through the timing belt 48 to the shift gear 49. The shift gear 49 is fixed to the hook guide shaft 46. Hence, the hook 45 which is fixed to the hook guide shaft 46 is rotated by the rotation of the hook guide shaft 46.

If the hook 45 is rotated in the counterclockwise direction, the lever 43, the projection of which is fitted to the recess of the hook 45, is lowered to contact the lower limiter part 44*b*. If the lever 43 is lowered, the rotor plate 41 is rotated in the clockwise direction. By the rotation of the rotor plate 41, the carriage guide 3 which is fixed to the off-center part of the rotor plate 41 is moved in the up direction. Thus, the carriage 2 is moved in the up direction. In this manner, the relative position of the carriage 2 to the transport belt 14 can be adjusted in the up/down direction by controlling the amount of rotation of the gap adjusting motor 47.

It is preferred to arrange the carriage guide 3 to the rotor plate 41 so that, when the rotor plate 41 is placed in the middle of the rotational range thereof, the central axis of the rotor plate 41 and the central axis of the carriage guide 3 are placed in a horizontal position. If the carriage guide 3 is arranged in this way, the amount of vertical movement of the carriage guide 3 in the rotational range of the rotor plate 41 can be larger and the amount of horizontal movement of the carriage guide 3 can be small. The amount of adjustment of the gap is monitored by using a gap adjustment sensor 50 and a gap adjustment scale 51. The gap adjustment sensor 50 and the gap adjustment scale 51 are attached to the shift gear 49. Based on the result of the monitoring, a stop position of the carriage guide 3 is determined.

In the above-described embodiment, the gap changing part 62 is disposed on the side of the front side plate 10. Alternatively, the gap changing part 62 may be disposed on the side of the back side plate 11. Alternatively, the gap changing part 62 may be disposed on each of the sides of the front side plate 10 and the back side plate 11.

Figure 5:
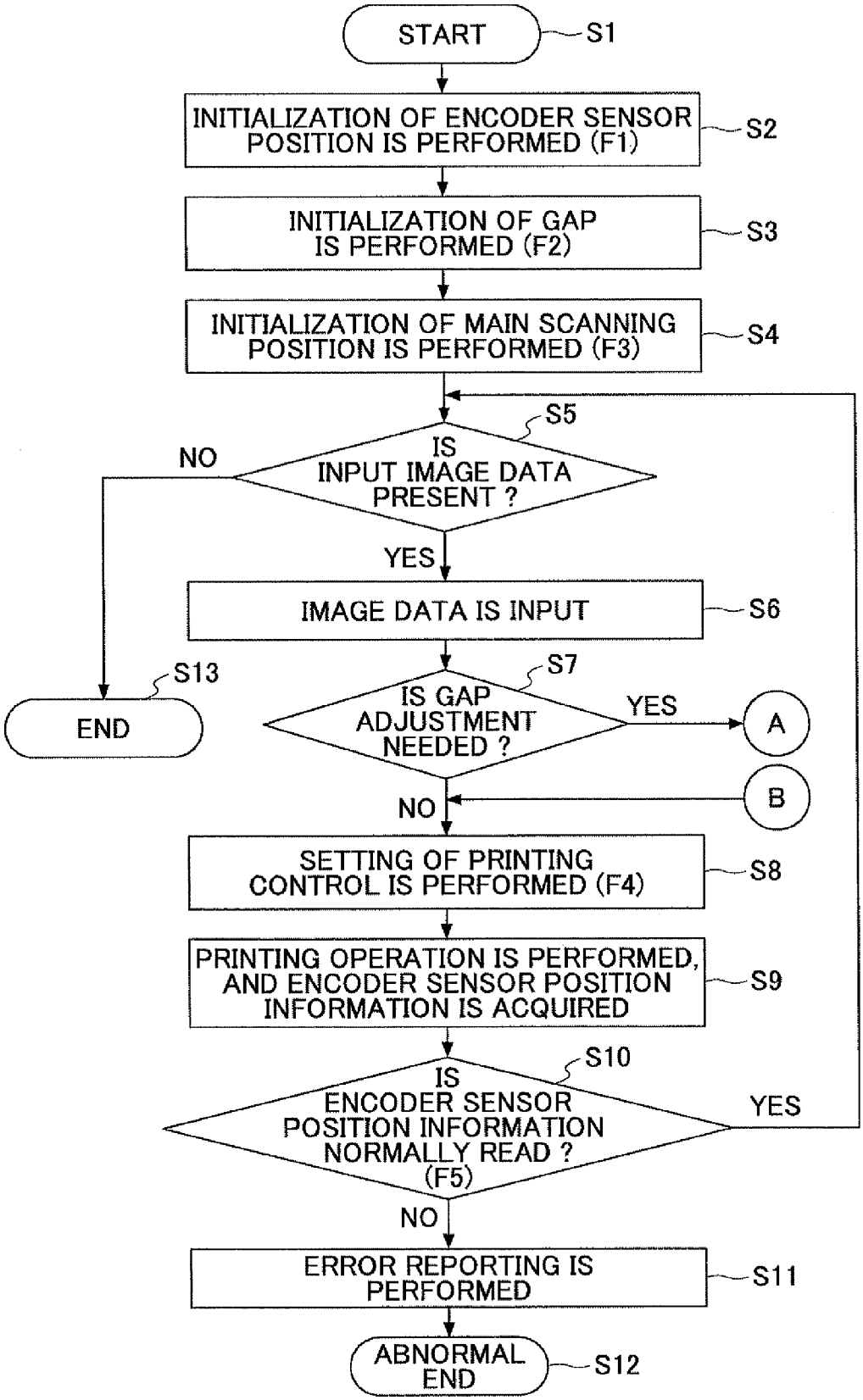
FIG. 5 is a flowchart for explaining a whole image formation process performed by the image forming device of an embodiment of the invention.

FIG. 5 is a flowchart for explaining a whole image formation process which is performed by the image forming device of an embodiment of the invention.

This flowchart is to explain the operation of slit reading of the linear scale by the encoder sensor arranged in the carriage of the invention.

Some of the steps of the whole image formation process illustrated in FIG. 5 will be described separately with reference to other flowcharts as illustrated in FIGS. 6-14.

As illustrated in FIG. 5, when the power supply switch is turned ON or the energy-saving return button is pressed by the user, the image forming device of this embodiment starts performing the whole image formation process (S1).

Upon start of the whole image formation process of FIG. 5, initialization of the encoder sensor position is performed (S2). The process of initialization of the encoder sensor position will be described later as a sensor position initialization process F1 of FIG. 6.

Next, initialization of the gap is performed (S3). The process of initialization of the gap will be described later as a gap initialization process F2 of FIG. 7.

Next, initialization of the main scanning position is performed (S4). The process of initialization of the main scanning position will be described later as a main scanning position initialization process F3 of FIG. 8.

When all the processes of sensor position initialization (S2), gap initialization (S3) and main scanning position initialization (S4) are completed, it is determined whether an input image data is present (S5).

When no input image data is present in step S5, the whole image formation process is terminated (S3). When an input image data is present in step S5, the input image data is input (S6). Next, it is determined whether the gap adjustment is needed (S7).

The gap adjustment is usually performed when the thickness of a printing medium, such as a printing sheet, changes. When the gap adjustment is needed (Yes in S7), the gap adjustment is performed. The process of gap adjustment will be described later as a gap adjustment process of FIG. 9

When the gap adjustment is not needed (No in S7), setting of printing control is performed (S8). The process of setting of printing control will be described later as a printing control setting process F4 of FIG. 10.

When the setting of printing control is completed, a printing operation is performed and image formation is performed (S9). At this time, encoder sensor position information is acquired from the linear scale by using the encoder sensor, simultaneously with the printing operation.

Next, the encoder sensor movement control part 64 determines whether the encoder sensor can normally read the position information (encoder position information) from the linear scale, based on the position information read by the encoder sensor (S10). The process of this determination will be described later as a sensor position normalization process F5 of FIG. 11.

If the encoder sensor can normally read the position information, then it is determined that the carriage operates normally. At this time, the control is returned to the step S5 in which it is determined whether the following input image data is present. Thereafter, the subsequent steps S6-S10 are repeated.

If the encoder sensor cannot normally read the position information (No in S10), the image forming device notifies error information to the user (S11). The whole image formation process of the image forming device is abnormally stopped (S12).

The timing at which the sensor position normalization process F5 is performed is not limited to only during the printing operation as in the above-described embodiment. Alternatively, the sensor position normalization process F5 may be performed when the energy-saving return button or the power supply switch is turned ON. Alternatively, the process F5 may be performed immediately after the maintenance recovery action of the carriage is performed, or immediately after the printer cover is opened or closed by the user.

Figure 6:
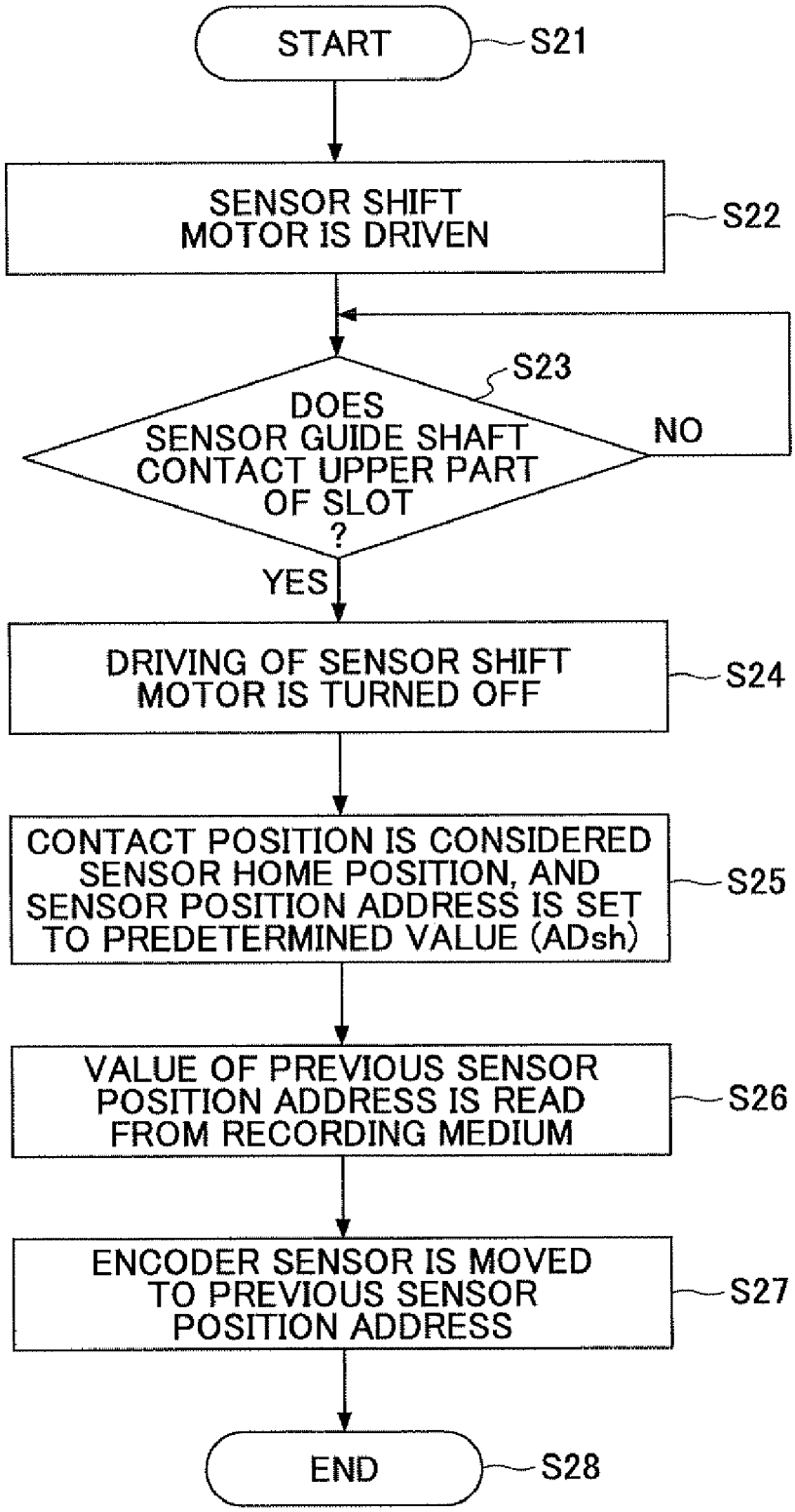
FIG. 6 is a flowchart for explaining a sensor position initialization process F1 in the whole image formation process as illustrated in FIG. 5.

FIG. 6 is a flowchart for explaining the sensor position initialization process F1 for the encoder sensor moving part 65 illustrated in FIG. 3.

Upon start of the sensor position initialization process F1 of FIG. 6 (S21), the sensor shift motor 25 is driven (S22), the cam plate 33 is rotated in the counterclockwise direction in FIG. 3, and the sensor guide shaft 31 is raised to the upper limit.

The upward movement of the sensor guide shaft 31 is regulated by the upper limit of the slot 32, and the upward movement beyond the upper limit of the slot 32 is impossible. In this case, the upper limit of the slot 32 constitutes an upper limit part of the sensor guide shaft 31.

If the sensor guide shaft 31 does not reach the upper limit part (No in S23), the sensor shift motor 35 is continuously driven. If the sensor guide shaft 31 reaches the upper limit part (Yes in S23), the driving of the sensor shift motor 25 is turned OFF (S24). This position is determined as being a sensor home position, and a sensor position address is set to a predetermined value (ADsh) (S25).

Next, the value of a previous sensor position address which is stored previously in the recording medium at the time of image formation is read out from the recording medium (S26), and the encoder sensor is moved to the previous sensor position address (S27). Then, the sensor position initialization process F1 is terminated (S28).

Figure 7:
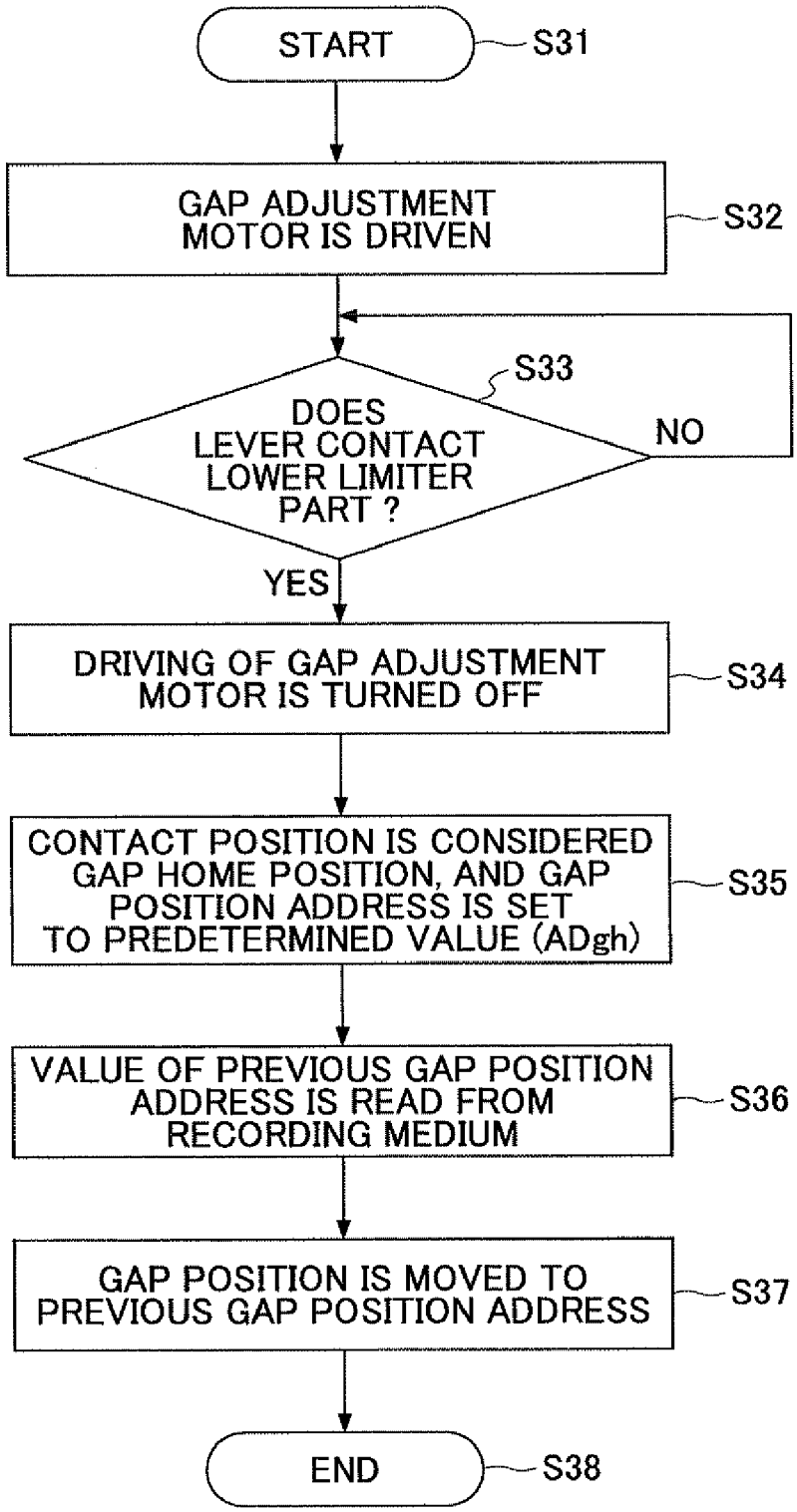
FIG. 7 is a flowchart for explaining a gap initialization process F2 in the whole image formation process as illustrated in FIG. 5.

FIG. 7 is a flowchart for explaining the gap initialization process F2 for the gap changing part illustrated in FIG. 4.

Upon start of the gap initialization process F2 (S31), the gap adjusting motor 47 is driven (S32), and the hook 45 is rotated in the counterclockwise direction in FIG. 4 to lower the lever 43. The downward movement of the lever 43 is regulated by the lower limiter part 44*b*, and the downward movement beyond the lower limiter part 44*b* is impossible.

If the lever 43 does not reach the lower limiter part 44*b* (No in S33), the gap adjusting motor 47 is continuously driven. If the lever 43 reaches the lower limiter part 44*b* (Yes in S33), the driving of the gap adjusting motor 47 is turned OFF (S34). This position is determined as being a gap home position, and a gap position address is set to a predetermined value (ADgh) (S35).

Next, the value of a previous gap position address which is stored previously in the recording medium at the time of image formation is read out from the recording medium (S36), and the gap position is changed to the previous gap position address (S37). Then, the gap initialization process F2 is terminated (S38).

Figure 8:
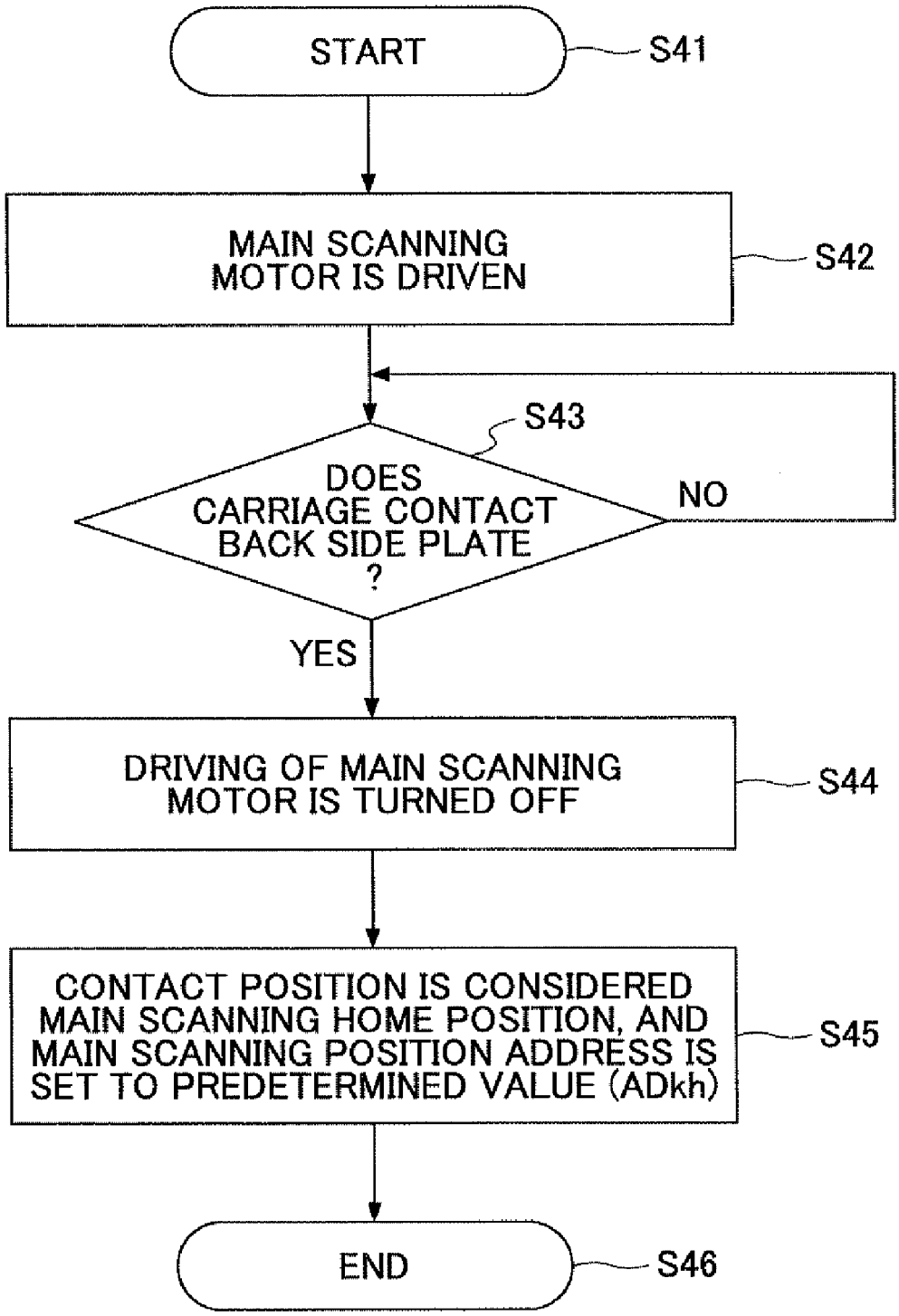
FIG. 8 is a flowchart for explaining a main scanning position initialization process F3 in the whole image formation process as illustrated in FIG. 5.

FIG. 8 is a flowchart for explaining the main scanning position initialization process F3 for the carriage 2 in the image forming device illustrated in FIG. 1.

Upon start of the main scanning position initialization process F3 (S41), the main scanning motor 7 is driven (S42). For example, the carriage 2 is moved to the direction of the back side plate 11.

If the carriage 2 does not reach the back side plate 11 (No in S43), the main scanning motor 7 is continuously driven. If the carriage 2 reaches the back side plate 11 (Yes in S43), the driving of the main scanning motor 7 is turned OFF (S44). This position is determined as being a main scanning home position, and a main scanning position address is set to a predetermined value (ADkh) (S45). Then, the main scanning position initialization process F3 of the carriage 2 is terminated (S46).

Figure 9:
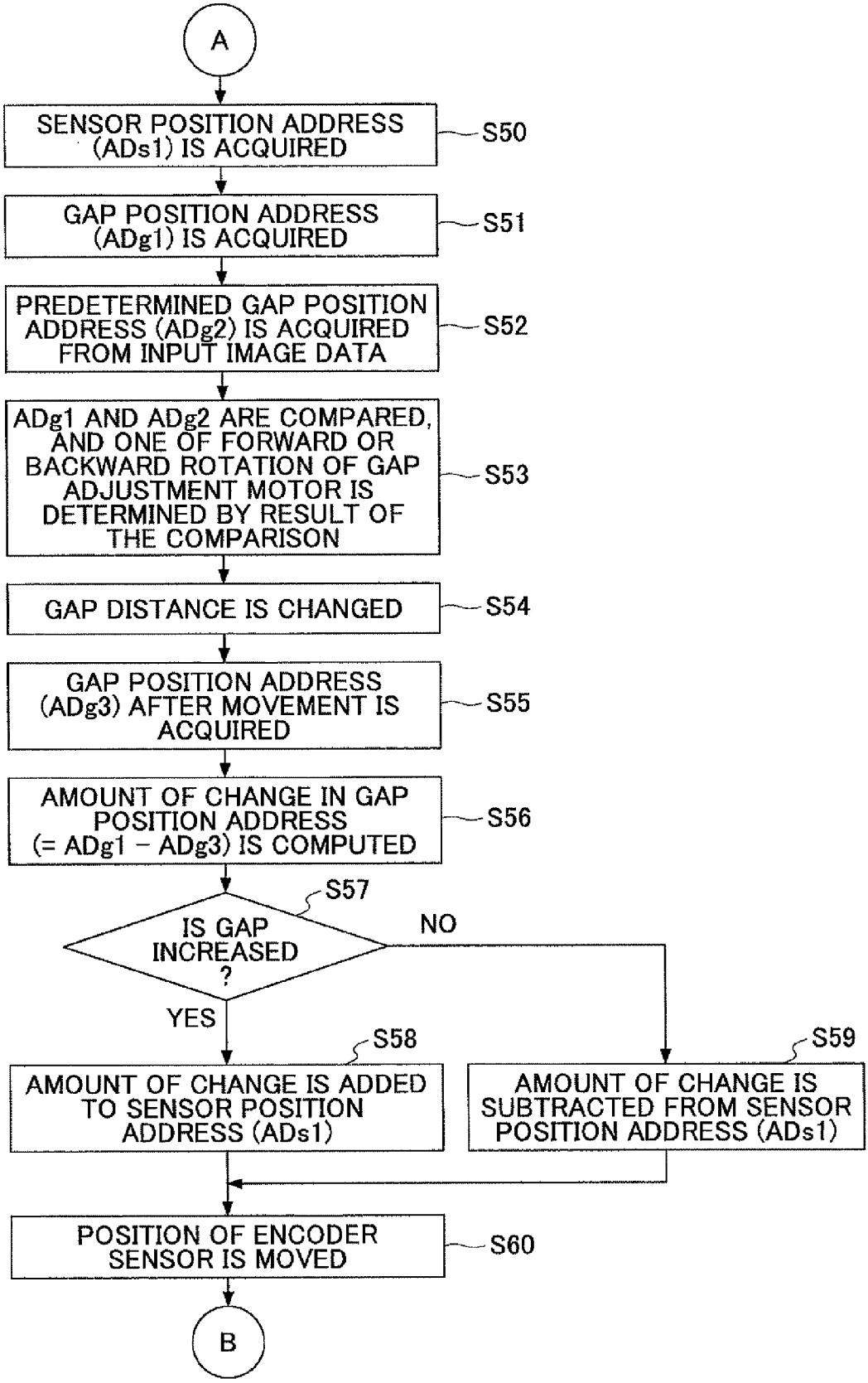
FIG. 9 is a flowchart for explaining a gap adjustment process in the whole image formation process as illustrated in FIG. 5.

FIG. 9 is a flowchart for explaining the gap adjustment process for the gap changing part 62 illustrated in FIG. 4 and the sensor moving part 65 illustrated in FIG. 3.

When adjustment of the gap between the carriage 2 and the platen (the surface of the transport belt 14) is needed (Yes in S7) in the whole image formation flowchart of FIG. 5, the gap adjustment process of FIG. 9 is started. Upon start of the gap adjustment process of FIG. 9, a sensor position address (ADs1) of the encoder sensor is acquired (S50).

Next, a gap position address (ADg1) of the gap changing part 62 illustrated in FIG. 4 is acquired (S51). Next, a predetermined gap position address (ADg2) is acquired from the input image data information (S52).

The gap position address (ADg1) is compared with a predetermined gap position address (ADg2), and a difference between the two position addresses is computed (S53). Next, the gap between the carriage 2 and the platen (the surface of the transport belt 14) is changed by the gap changing part 62 in accordance with the value of the computed difference (S54).

A gap position address (ADg3) of the gap changing part 62 after the gap is changed is acquired (S55), and a difference between the two position addresses ((ADg1)−(ADg3)) (or the amount of change in the gap position address) is computed (S56).

It is determined whether the gap is increased (or whether the amount of change in the gap position address ((ADg3)−(ADg1)) is larger than zero) (S57). If the gap is increased (Yes in S57), the amount of change in the gap position address ((ADg3)−(ADg1)) is added to the sensor position address (ADs1) (S58).

If the gap is not increased (No in S57), the amount of change in the gap position address ((ADg1)−(ADg3)) is subtracted from the sensor position address (ADs1) (S59). Then, the encoder sensor position is changed according to the sensor position address (S60).

By performing this operation, the encoder sensor position can be maintained so that the relative position (height) of the encoder sensor 5 to the linear scale 4 is the same as before of the gap adjustment.

The sensor position address is incremented when raising the encoder sensor 5 in the up direction, and the gap position address is decremented when increasing the gap.

When the conditions of the sensor moving part 65 and the conditions of the gap changing part 62 differ from each other, for example, when the movement distance of the gap changing part 62 per unit address differs from the movement distance of the sensor moving part 65 per unit address, the compensation which corresponds to the steps S58 and S59 may be performed.

If the compensation is performed in this manner, in the image forming device after a restart of operation, the reading position of the encoder sensor to the linear scale is not changed even when the gap is changed by the gap changing part 62. It is no longer necessary to detect a clean linear scale reading position again. Moreover, it is not necessary to make the width of the linear scale into a sum of the width of the gap adjustment and the width of the encoder sensor movement, and miniaturization of the linear scale is possible.

Figure 10:
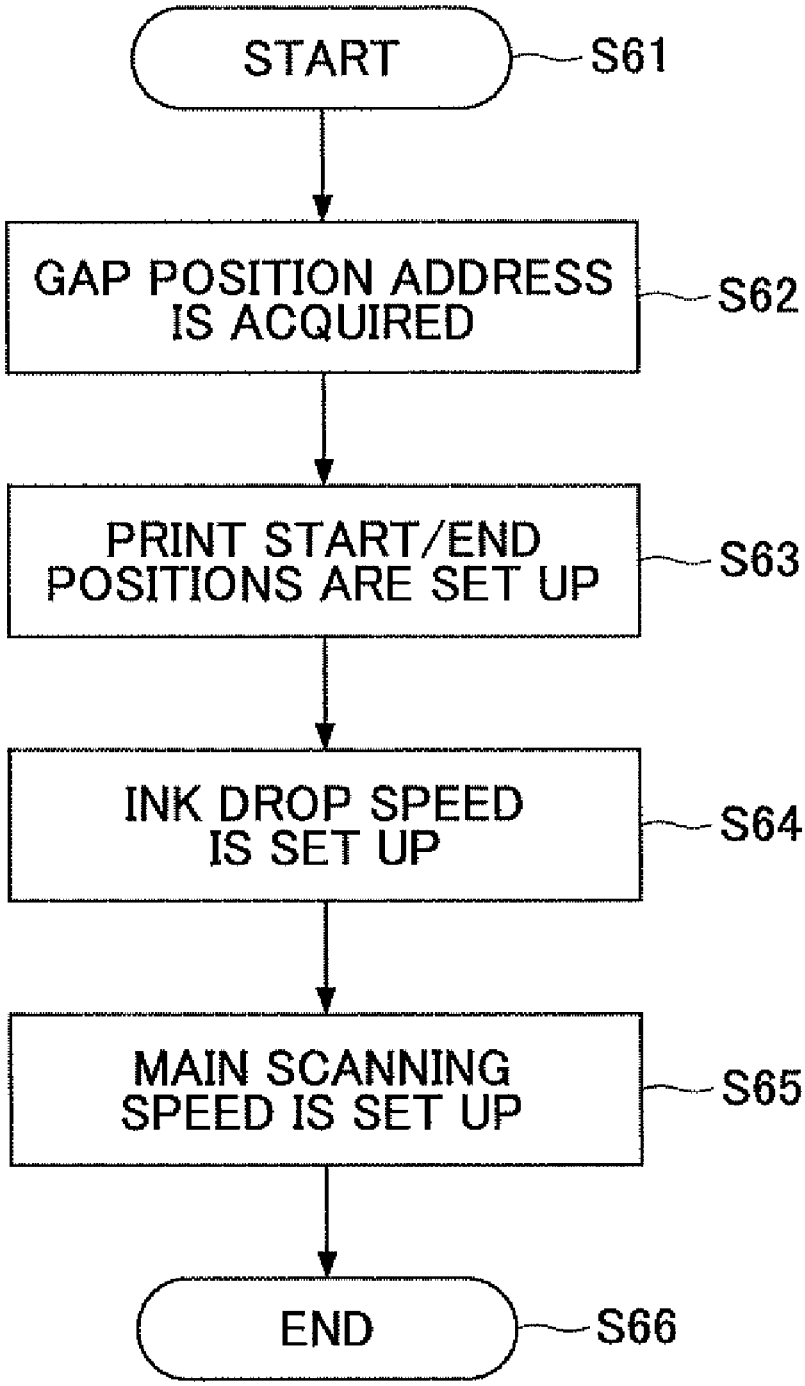
FIG. 10 is a flowchart for explaining a printing control initialization process F4 in the whole image formation process as illustrated in FIG. 5.

FIG. 10 is a flowchart for explaining the printing control setting process F4 in the whole image formation process illustrated in FIG. 5.

Upon start of the printing control setting process F4 of FIG. 10 (S61), the gap position address is acquired (S62). A print start position and a print end position on a printing sheet are set up (S63). An ink drop discharge speed is set up (S64). A main scanning speed is set up (S65). Then, the printing control setting process F4 of FIG. 10 is terminated (S66).

Figure 11:
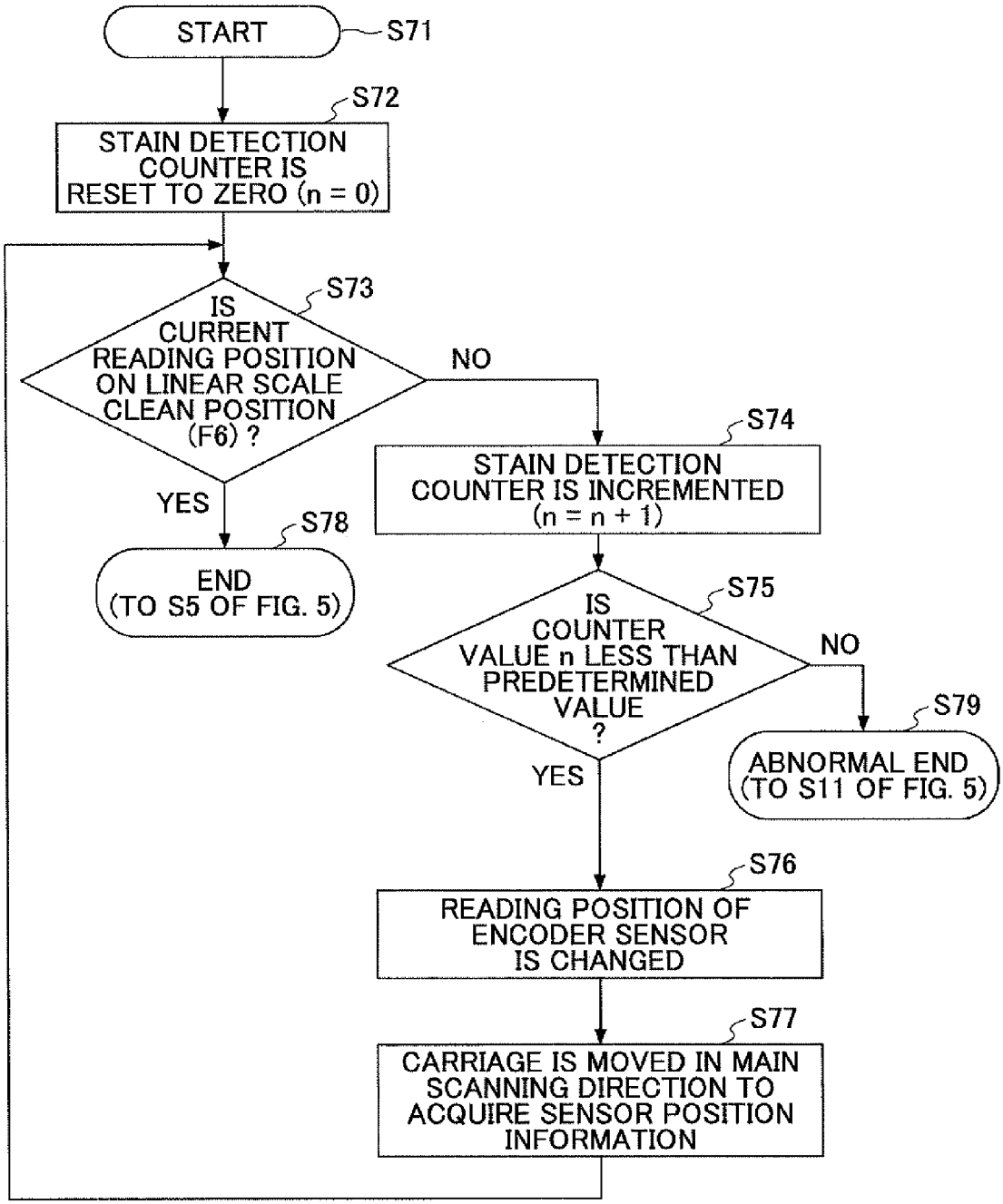
FIG. 11 is a flowchart for explaining a sensor position normalization process F5 in the whole image formation process as illustrated in FIG. 5.

FIG. 11 is a flowchart for explaining a sensor position normalization process F5 in the whole image formation process illustrated in FIG. 5.

Upon start of the sensor position normalization process F5 of FIG. 11 (S71), the stain detection counter of the encoder sensor movement control part 64 is reset to zero so that the counter value n=0 (S72).

It is determined whether the current reading position on the linear scale is clean (stain detection process F6) (S73). The stain detection process F6 will be described later.

If the current reading position on the linear scale is determined as being clean as a result of the stain detection process F6 (Yes in S73), the sensor position normalization process F5 of FIG. 11 is terminated (S78), and the control is returned to the step S5 in the whole image formation process of FIG. 5.

If the current reading position on the linear scale is determined as being not clean (stain) as a result of the stain detection process F6 (No in S73), the counter value of the stain detection counter is incremented (n=n+1) (S74).

Next, it is determined whether the counter value n is less than a predetermined value (S75). This predetermined value is equivalent to the number of times to search for the reading position of the linear scale 4 by the encoder sensor 5 in the width direction of the linear scale 4. Normally, the predetermined value is set to 2 or larger.

If the counter value n is less than the predetermined value (Yes in S75), the sensor reading position on the linear scale 4 is changed in the width direction of the linear scale 4 (S76). The carriage 2 is moved in the main scanning direction, and the sensor position information is acquired by the encoder sensor 5 (S77).

Based on the acquired sensor position information, it is determined again whether the current sensor reading position on the linear scale 4 after the movement is clean (S73).

After the step S73 is performed, the subsequent steps S74-S77 are repeated. If the current reading position on the linear scale 4 is determined as being clean as a result of the stain detection process F6 (Yes in S73), the sensor position normalization process F5 of FIG. 11 is terminated (S78). The control is returned to the step S5 in the whole image formation process of FIG. 5.

If it is determined in the step S75 that the counter value n is equal to or larger than the predetermined value, it is determined that an error in the image forming device takes place, and the control is returned to the step S11 in the whole image formation process of FIG. 5 (S79).

Figure 12:
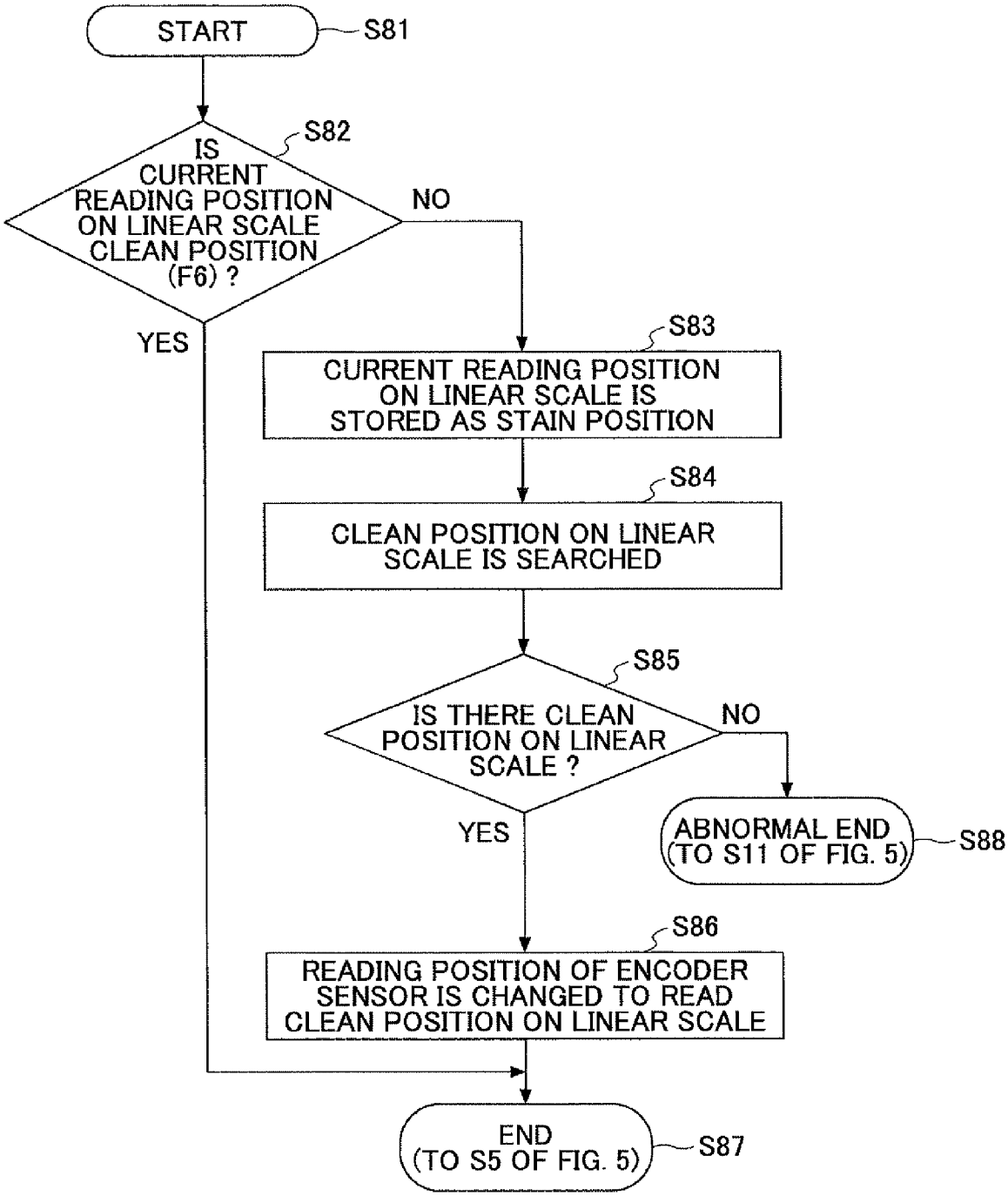
FIG. 12 is a flowchart for explaining another sensor position normalization process F5 in the whole image formation process as illustrated in FIG. 5.

FIG. 12 is a flowchart for explaining another sensor position normalization process F5 in the whole image formation flowchart of FIG. 5.

Upon start of the sensor position normalization process F5 of FIG. 12 (S81), it is determined whether the current reading position on the linear scale 4 is clean (stain detection process F6) (S82). Similar to FIG. 11, the stain detection process F6 will be described later.

If the current reading position on the linear scale 4 is determined as being clean as a result of the stain detection process F6 (Yes in S82), the sensor position normalization process F5 of FIG. 12 is terminated (S87), and the control is returned to the step S5 in the whole image formation process of FIG. 5.

If the current reading position on the linear scale 4 is determined as being not clean (stain) as a result of the stain detection process F6 (No in S82), the current reading position on the linear scale 4 is stored in the storage part 63 as a stain position (S83).

Next, a clean reading position on the linear scale, except the stain position on the linear scale, which is previously stored in the storage part 63, is searched (S84). It is determined whether there is a clean reading position on the linear scale (S85).

If there is no clean reading position on the linear scale 4 (No in S85), the sensor position normalization process F5 of FIG. 12 is abnormally ended (S88), and the control is returned to the step S11 in the whole image formation process of FIG. 5.

If a clean reading position exists on the linear scale 4 (Yes in S85), the sensor position is changed to allow the encoder sensor 5 to read the clean reading position on the linear scale 4 (S86), and the sensor position normalization process F5 of FIG. 12 is terminated (S87). The control is returned to the step S5 in the whole image formation process of FIG. 5.

Figure 13:
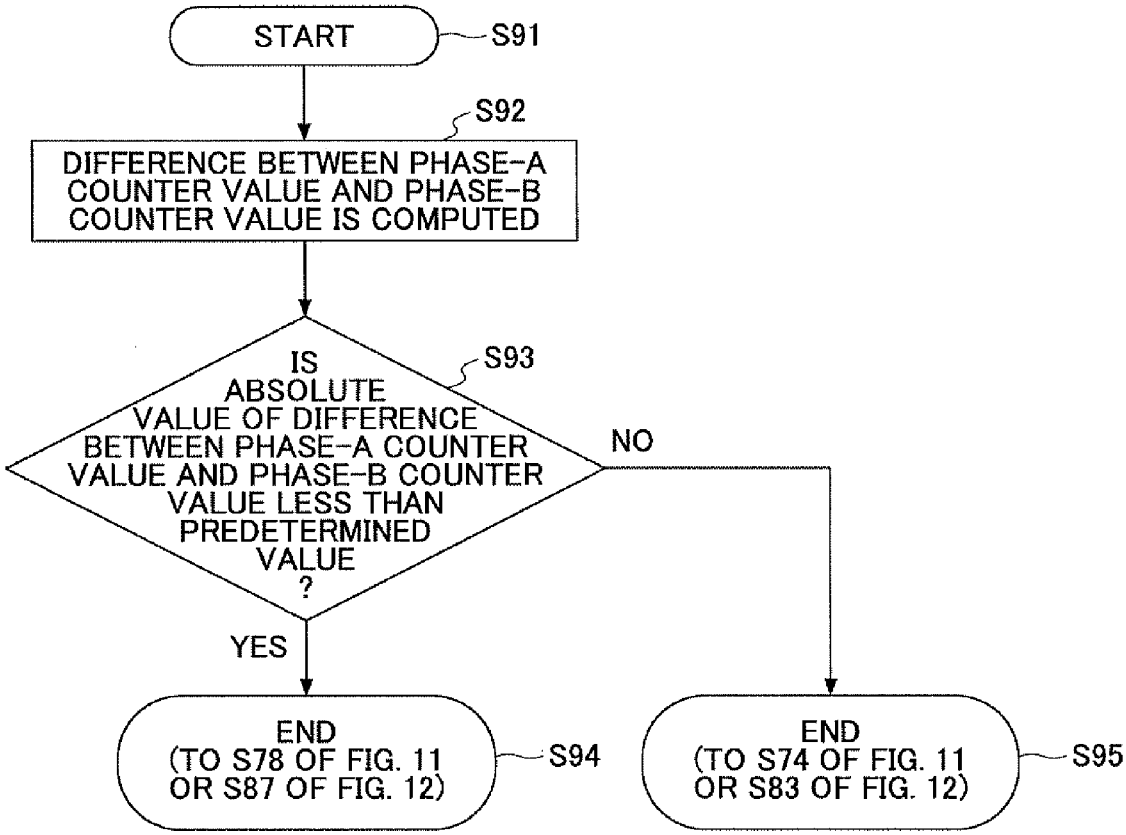
FIG. 13 is a flowchart for explaining a stain detection process F5 in the whole image formation process as illustrated in FIG. 5.

FIG. 13 is a flowchart for explaining a stain detection process F6 in the sensor position normalization process F5 illustrated in FIG. 11 or FIG. 12.

Upon start of the stain detection process F6 (S91), the stain detection part 70 in FIG. 2 computes a difference between the phase A counter value and the phase B counter value of the sensor position information (S92). It is determined whether the absolute value of the difference between the phase A counter value and the phase B counter value is less than a predetermined value (S93).

If the absolute value of the difference between the phase A counter value and the phase B counter value is less than the predetermined value (Yes in S93), it is determined that there is no stain on the linear scale 4, and the control is returned to the step S78 of the process of FIG. 11 or the step S87 of the process of FIG. 12.

If the absolute value of the difference between the phase A counter value and the phase B counter value is equal to or larger than the predetermined value, it is determined that a stain exists on the linear scale 4, and the control is returned to the step S74 of the process of FIG. 11 or the step S83 of the process of FIG. 12.

Figure 14:
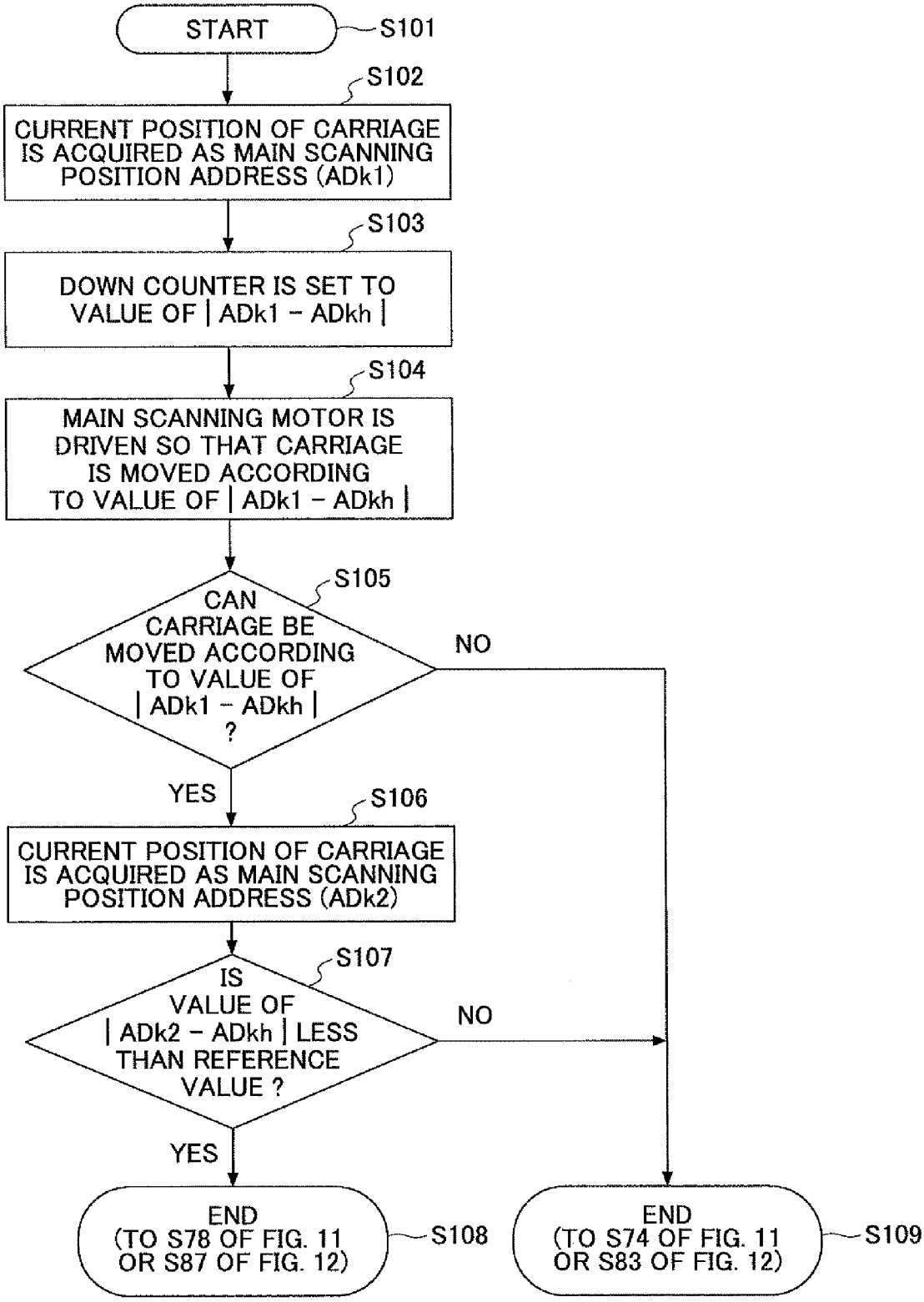
FIG. 14 is a flowchart for explaining another stain detection process F5 in the whole image formation process as illustrated in FIG. 5.

FIG. 14 is a flowchart for explaining another stain detection process F6 in the sensor position normalization process F5 illustrated in FIG. 11 or FIG. 12.

Upon start of the stain detection process F6 of FIG. 14 (S101), the current main scanning position address (ADk1) of the carriage 2 is acquired (S102).

The down counter is set to the value of the difference ((ADk1)−(ADkh)) between the current main scanning position address (ADk1) and the main scanning home position (ADkh) of the carriage 2 (S103).

The main scanning motor 7 is driven to move the carriage 2 in the main scanning direction by the value of ((ADk1)−(ADkh)) set in the down counter (S104).

It is determined whether the carriage 2 can be moved by the value of ((ADk1)−(ADkh)) set in the down counter (S105). When the result of the determination in the step S105 is affirmative (Yes in S105), the current position of the carriage 2 after the movement is acquired as a main scanning position address (ADk2) (S106).

It is determined whether the absolute value of a difference ((ADk2)−(ADkh)) between the current main scanning position address (ADk2) and the main scanning home position (ADkh) of the carriage 2 is less than a predetermined reference value (S107).

When the absolute value of ((ADk2)−(ADkh)) is less than the predetermined reference value (Yes in S107), it is determined that the carriage 2 is operating normally and no stain is present on the linear scale 4. The control is returned to the step S78 of the process of FIG. 11 or the step S87 of the process of FIG. 12 (S108).

On the other hand, when the carriage 2 cannot be moved by the value ((ADk1)−(ADkh)) (No in S105), or when the absolute value of ((ADk2)−(ADkh)) is equal to or larger than the predetermined reference value (No in S107), it is determined that there is a stain on the linear scale (S109). The control is returned to the step S74 of the process of FIG. 11 or the step S83 of the process of FIG. 12.

According to the stain detection process F6 of FIG. 13 or FIG. 14, it is possible to accurately detect a stain on the linear scale, regardless of whether the main scanning speed of the carriage 2 is changed, and it is possible to perform the sensor position normalization process.

Figure 15:
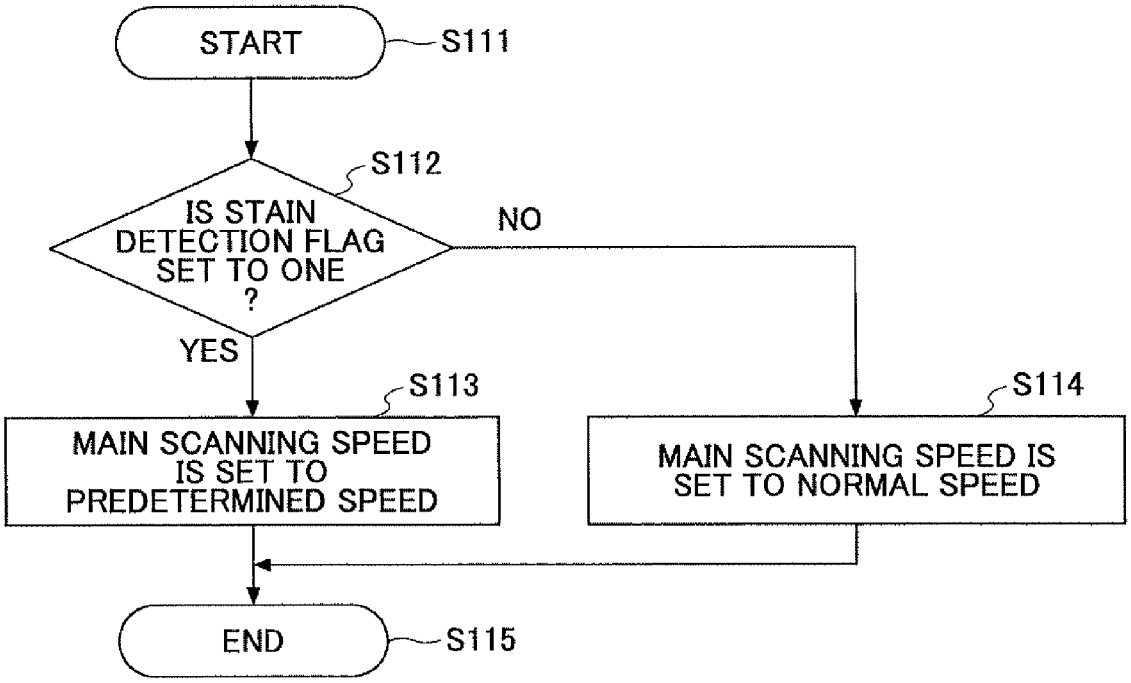
FIG. 15 is a flowchart for explaining a main scanning speed adjustment process in the sensor position normalization process as illustrated in FIG. 11.

FIG. 15 is a flowchart for explaining a process of adjusting the main scanning speed of the carriage when the result of the stain detection process F6 (step S73) in the sensor position normalization process F5 of FIG. 11 is negative.

When the result of the stain detection process F6 (step S73) in the sensor position normalization process F5 of FIG. 11 is negative, the carriage main scanning control unit 61 sets a stain detection flag to one. On the other hand, when the result of the stain detection process F6 (step S73) is affirmative, the carriage main scanning control unit 61 resets the stain detection flag to zero.

Upon start of the main scanning speed adjustment process of FIG. 15 (S111), it is determined whether the stain detection flag is set to one (S112). If the stain detection flag is set to one (Yes in S112), the main scanning speed of the carriage 2 is changed to a predetermined speed (S113).

Usually, when the stain detection flag is set to one, it is difficult to correctly control the position of the carriage 2, and the carriage may be moved at an unsuitable main scanning speed. In order to avoid the problem, it is preferred that the predetermined speed in the step S113 is smaller than a normal main scanning speed of the carriage 2.

If the stain detection flag is not set to one (No in S112), the main scanning speed of the carriage 2 is set to the normal main scanning speed (S114).

Figure 16:
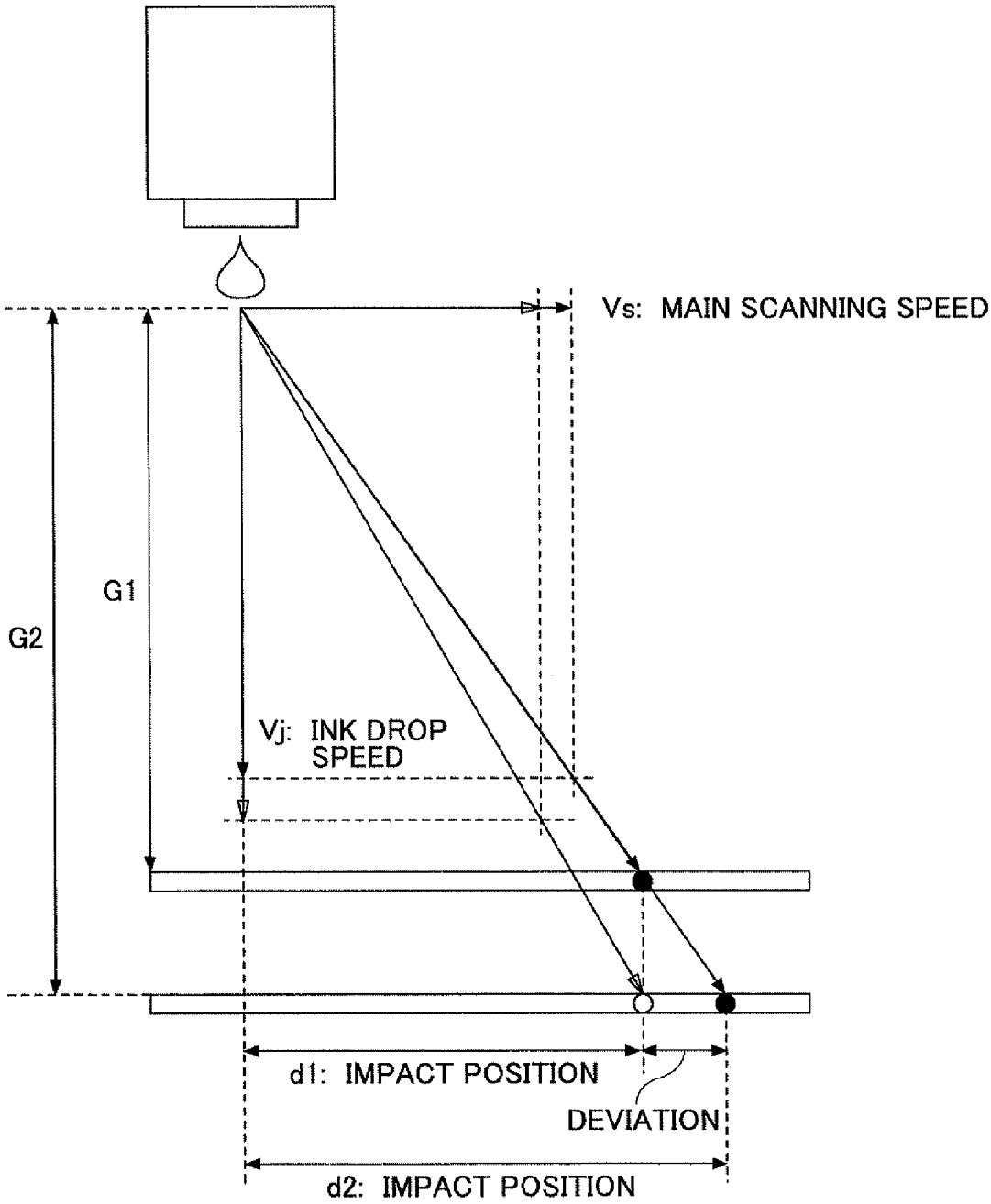
FIG. 16 is a diagram for explaining a deviation of an impact position when a gap is changed.

FIG. 16 is a diagram for explaining a deviation of an impact position of an ink drop on a printing medium when the gap is changed. In FIG. 16, the distance in the main scanning direction is taken along the horizontal axis, and the gap is taken along the vertical axis. The relationship between the main scanning speed Vs, the ink drop discharge speed Vj, and the ink drop impact position is illustrated in FIG. 16.

It is assumed that the head is carried on the carriage and the head is moving in the main scanning direction at the main scanning speed Vs. In this case, when an ink drop is discharged from the head to a printing medium at the ink drop discharge speed Vj, the ink drop flies in the speed and the direction which are defined by the resultant of the vector of the main scanning speed Vs and the vector of the ink drop discharge speed Vj. The ink drop flies across a gap "G1" between the head and the printing medium, and reaches the printing medium at an impact position "d1".

When the carriage is lifted in the up direction (the state in which the printing medium is lowered relative to the carriage is illustrated in FIG. 16) and the gap between the head and the printing medium is increased to "G2", an ink drop reaches the printing medium at an impact position "d2". A deviation of the impact position of the ink drop in this case is expressed by (d2−d1). It is assumed that the main scanning speed Vs and the ink drop speed Vj are left unchanged.

Because an ink drop flies in the speed and the direction which are defined by the resultant of the vector of the main scanning speed Vs and the vector of the ink drop discharge speed Vj, changing the main scanning speed Vs and the ink drop discharge speed Vj enables the ink drop to reach the printing medium at the target impact position "d1".

A method of determining a deviation of the impact position will be described. It is assumed that the ink drop is not influenced by air and the ink drop discharge speed is not attenuated until it reaches the printing medium.

(1) An arrival time "t" of an ink drop to reach the printing medium is determined based on the gap G between the head and the printing medium and the ink drop discharge speed Vj.

(2) The ink drop has the main scanning speed Vs in the main scanning direction, and the ink travel distance (impact position d) until the ink drop reaches the printing medium is represented by the formula: d=the arrival time t×the main scanning speed Vs.

Specifically, the impact position d1 in the case of G1=1.0 mm, Vj=10000 mm/s, Vs=1000 mm/s, is determined as follows.

The arrival time t=G1/Vj=1.0/10000=0.0001 seconds (=100 microseconds).

The impact position d1=t×Vs=0.0001×1000=0.1 mm.

Similarly, the impact position in the case of G2=1.5 mm, Vj=10000 mm/s, Vs=1000 mm/s, is determined as follows.

The arrival time t=G2/Vj=1.5/10000=0.00015 seconds (=150 microseconds).

The impact position d1=t×Vs=0.00015×1000=0.15 mm.

Accordingly, the deviation of the impact position when the gap between the head and the printing medium is changed from 1.0 mm to 1.5 mm is determined as being equal to (0.15−0.1)=0.05 mm. This deviation is equivalent to about 1 dot in the case of 600 dpi resolution.

A new main scanning speed Vs needed to compensate the deviation of the impact position when the gap is changed to 1.5 mm and attain the target impact position d1 (G1=1.0 mm) is computed by the formula:

$$Vs=d1\times Vj/G2=0.1\times 1000/1.5=666.67\text{ mm/s}.$$

Therefore, if printing is performed by changing the main scanning speed Vs from 1000 mm/s to 666.67 mm/s, the deviation of the impact position can be compensated.

In order to simplify the computation processing by the software, the compensation of the ink drop speed Vj and the main scanning speed Vs when the gap between the head and the printing medium is changed may be implemented by preparing a table containing measurement values computed beforehand by experiment, and selecting candidate values from the table.

According to the above embodiment, it is possible to output an image with good quality including no deviation of impact position even when the gap is changed by the gap changing part.

Figure 17:
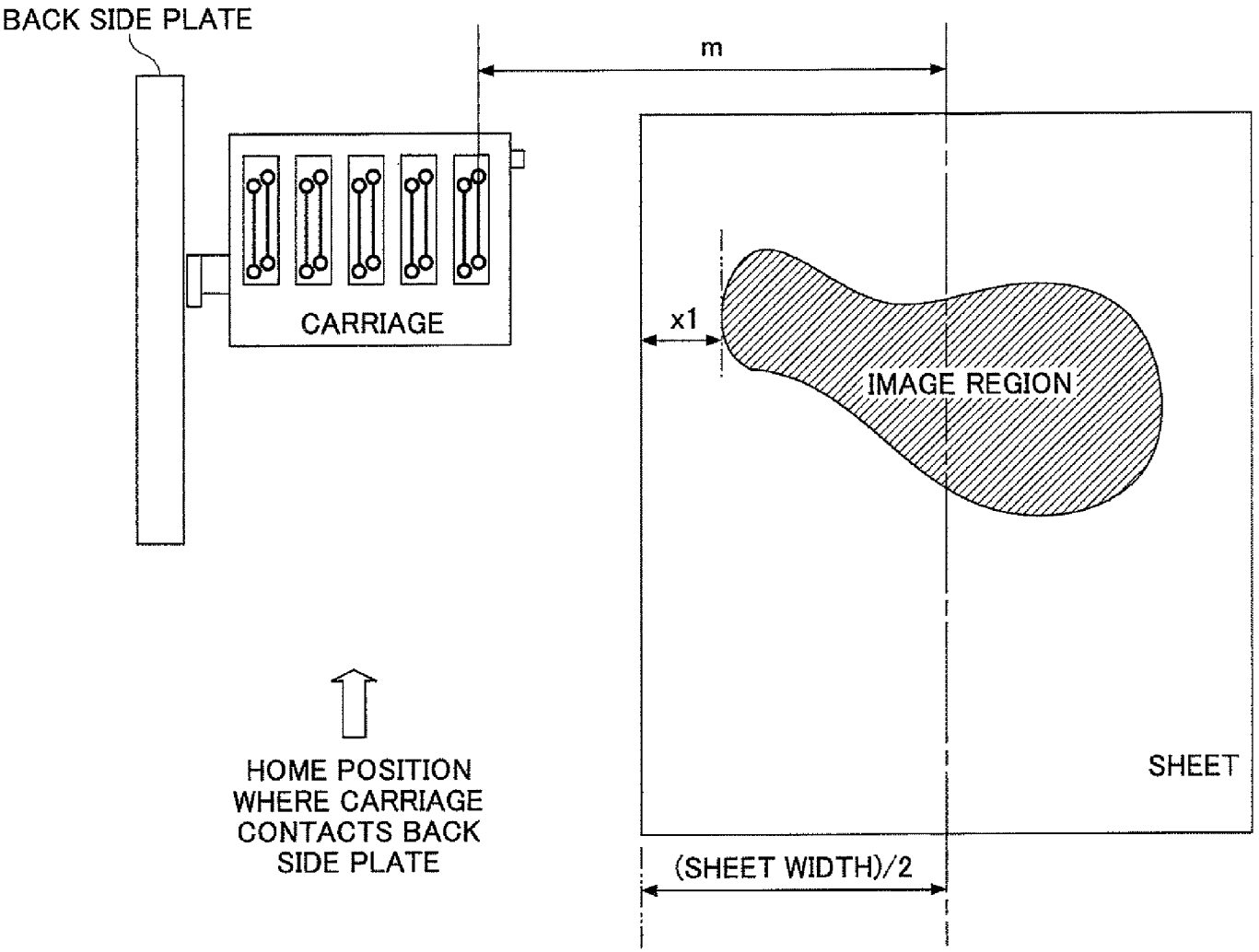
FIG. 17 is a diagram for explaining a print start position on a printing sheet.

FIG. 17 is a diagram for explaining a print start position on a printing sheet. In FIG. 17, "m" denotes a distance from the center of the device in the main scanning direction (which center is also the center of the recording sheet) to the nozzle of the Y (yellow) head (which is disposed on the side of the recording sheet) on the carriage located at its home position, and "X1" denotes a distance from the end of the recording sheet to the print start position of input image data. This home position is a position where the carriage contacts the back side plate.

As is apparent from FIG. 17, the print start position is represented by the formula:

$$\text{(print start position)}=m\times 600/254\text{(recording sheet width)}/2+(X1\times 600/\text{(resolution)}).$$

Figure 18A:
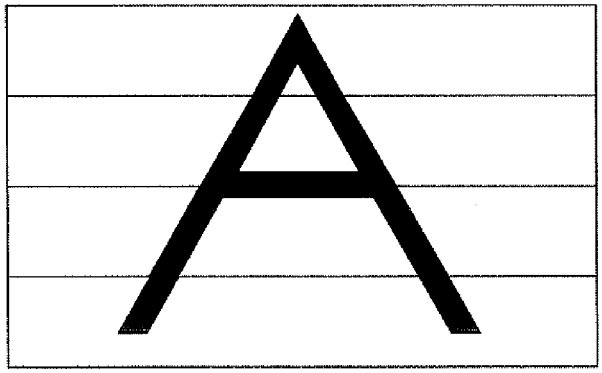
FIG. 18A, FIG. 18B and FIG. 18C are diagrams for explaining the reason for changing a print start position.
Figure 18B:
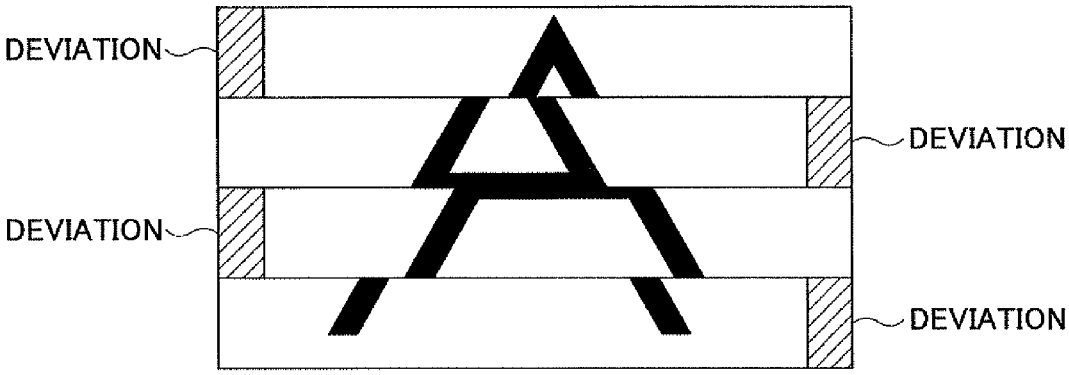
Figure 18C:
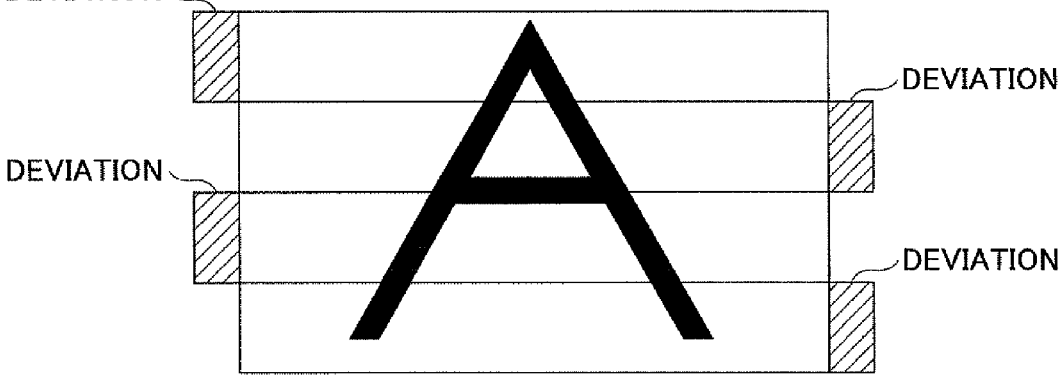

FIG. 18A, FIG. 18B and FIG. 18C are diagrams for explaining the reason for changing a print start position.

As described above with reference to FIG. 16, when the gap between the head and the printing medium is changed, a deviation of the impact position of an ink drop occurs if the main scanning speed Vs and the ink drop discharge speed Vj are left unchanged. Specifically, with respect to an input image data as illustrated in FIG. 18A, a deviation of the impact position of an ink drop occurs in each of the portions where the gap is changed, and the output image formed on a printing sheet is turned into an image having offset portions, as illustrated in FIG. 18B.

In order to eliminate the problem, the print start position is changed by an offset corresponding to the deviation in the image portion where the gap is changed. As a result, an output image with good quality as illustrated in FIG. 18C is obtained. In the case of one-directional printing, an offset is applied to all the scans. In the case of bidirectional printing, an offset is applied to either of the forward and backward scans.

In this way, even when the gap is changed by the gap changing part, an image with good quality in which the impact position does not deviate can be output by using simple control of the software.

Figure 19A:
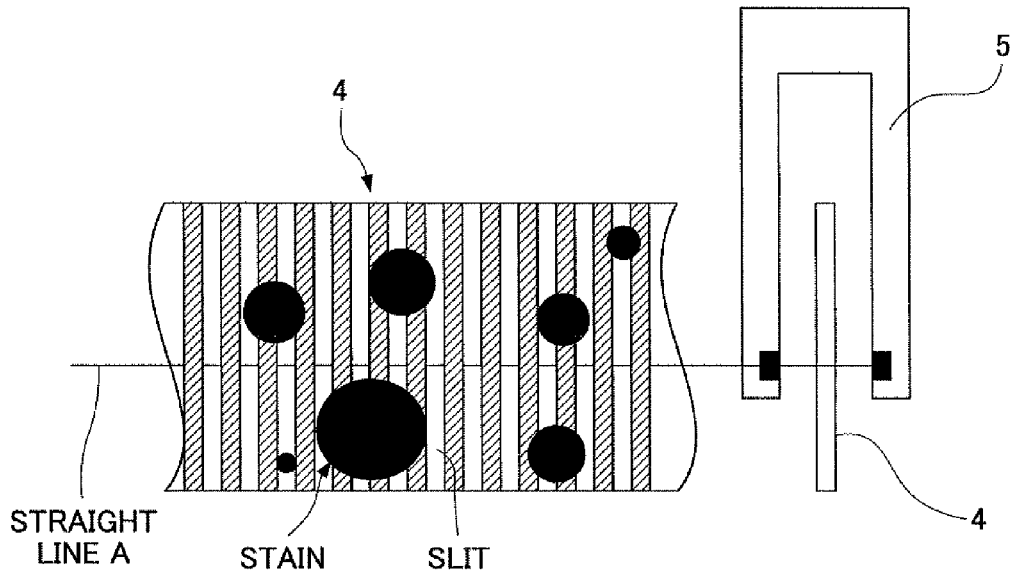
FIG. 19A and FIG. 19B are diagrams for explaining the detection of slits on the linear scale by the encoder sensor when a stain is present on the linear scale.
Figure 19B:
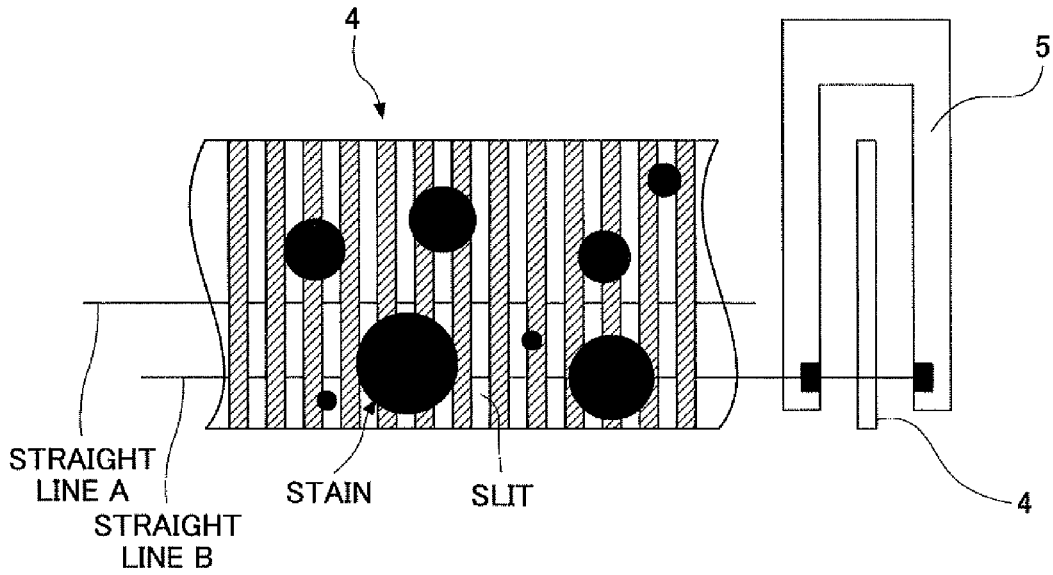

FIG. 19A and FIG. 19B are diagrams for explaining the detection of slits on the linear scale by the encoder sensor when a stain is present on the linear scale.

When the slit reading part of the encoder sensor 5 lies on a straight line A (or horizontal straight line) in the longitudinal direction of the linear scale 4 as illustrated in FIG. 19A, the portion of the linear scale 4 in which the stain is present is not read by the encoder sensor 5, and the encoder sensor 5 outputs the normal detection signal.

On the other hand, when the slit reading part of the encoder sensor 5 lies on a straight line B (or horizontal straight line) as illustrated in FIG. 19B, the slits cannot be read correctly because of the stain on the linear scale, and a pulse omission or the like occurs in the detection signal output from the encoder sensor 5.

If the detection signal output from the encoder sensor 5 is confused due to the pulse omission or the like, accurate positional information of the carriage cannot be acquired and it is difficult to move the carriage normally.

As described in the foregoing, when a stain is present in the slit reading part of the encoder sensor (for example, on the straight line B in FIG. 19B), the portion of the linear scale 4 in which no stain is present (for example, on the straight line A in FIG. 19B) is searched, and the slit reading part of the encoder sensor is moved to such a portion, so that the slits on the linear scale are read there.

If the carriage is allowed to normally perform the scanning movement, it is not necessary to change the slit reading part of the encoder sensor even when a stain is present partially on the horizontal line on the linear scale.

According to this invention, it is possible to provide a carriage which is able to operate normally over an extended period of time based on the position information from the encoder sensor which is controlled to read the slits on the linear scale accurately. Furthermore, it is possible to provide an image forming device including the carriage arranged therein which is able to form an image with high quality over an extended period of time.

The present invention is not limited to the specifically disclosed embodiments, and variations and modifications may be made without departing from the scope of the present invention.

The present application is based on Japanese patent application No. 2008-178356, filed on Jul. 8, 2008, and Japanese patent application No. 2009-124540, filed on May 22, 2009, the contents of which are incorporated herein by reference in their entirety.

What is claimed is:

1. A carriage of a liquid drop discharging device in which an encoder sensor is arranged to read slits on a linear scale at a slit reading position, comprising:

a stain detection part to detect a stain on the linear scale based on position information output from the encoder sensor;

an encoder sensor moving part to move the encoder sensor from the slit reading position in a width direction of the linear scale; and an encoder sensor movement control part to control movement of the encoder sensor from the slit reading position by the encoder sensor moving part based on stain information output from the stain detection part, wherein the stain detection part consecutively receives first and second position information items from the encoder sensor after the carriage is moved in a main scanning direction from a first position to a second position, the encoder sensor reads the slits on the linear scale respectively for the first and second positions, and the stain detection part determines whether a stain is present on the linear scale by comparison of the first position information item and the second position information item.

2. The carriage according to claim 1, further comprising a gap changing part to change a gap between a liquid drop discharging head of the liquid drop discharging device and a sheet transport device which transports a printing sheet which receives liquid drops discharged from the liquid drop discharging head, and the encoder sensor movement control part controls the encoder sensor moving part to compensate for the gap changed by the gap changing part.

3. The carriage according to claim 1, further comprising a storage part to store a position of a stain on the linear scale detected by the stain detection part, wherein the encoder sensor movement control part controls movement of the encoder sensor by the encoder sensor moving part, so that the encoder sensor reads the slits on the linear scale at a slit reading position other than the detected position of the stain stored in the storage part.

4. The carriage according to claim 2, wherein the gap changing part functions as the encoder sensor moving part to move the encoder sensor in the width direction of the linear scale.

5. The carriage according to claim 1, wherein, when a stain on the linear scale is detected by the stain detection part, a main scanning speed of the carriage is changed.

6. The carriage according to claim 1, further comprising an error reporting part to report to a user that the stain detection part has detected a stain on the linear scale, after the slit reading position of the encoder sensor is moved by the encoder sensor moving part.

7. An image forming device in which a carriage of a liquid drop discharging device is arranged, including an encoder sensor arranged to read slits on a linear scale at a slit reading position, the carriage comprising:

a stain detection part to detect a stain on the linear scale based on position information output from the encoder sensor;

an encoder sensor moving part to move the encoder sensor from the slit reading position in a width direction of the linear scale; and an encoder sensor movement control part to control movement of the encoder sensor from the slit reading position by the encoder sensor moving part based on stain information output from the stain detection part, wherein the stain detection part consecutively receives first and second position information items from the encoder sensor after the carriage is moved in a main scanning direction from a first position to a second position, the encoder sensor reads the slits on the linear scale respectively for the first and second positions, and the stain detection part determines whether a stain is present on the linear scale by comparison of the first position information item and the second position information item.

* * * * *